US010180112B2

(12) United States Patent
Hayashita et al.

(10) Patent No.: US 10,180,112 B2
(45) Date of Patent: Jan. 15, 2019

(54) ABNORMALITY DIAGNOSIS SYSTEM OF AIR-FUEL RATIO SENSOR

(71) Applicant: TOYOTA JIDOSHA KABUSHIKI KAISHA, Toyota-shi, Aichi-ken (JP)

(72) Inventors: Go Hayashita, Chigasaki (JP); Hidenori Moriya, Nagoya (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 163 days.

(21) Appl. No.: 14/935,714

(22) Filed: Nov. 9, 2015

(65) Prior Publication Data

US 2016/0131064 A1 May 12, 2016

(30) Foreign Application Priority Data

Nov. 11, 2014 (JP) ..... 2014-228870

(51) Int. Cl.
*F02D 41/22* (2006.01)
*F02D 41/14* (2006.01)
*F02D 41/12* (2006.01)

(52) U.S. Cl.
CPC ..... *F02D 41/1495* (2013.01); *F02D 41/123* (2013.01); *F02D 41/126* (2013.01); *F02D 41/1441* (2013.01); *F02D 41/1454* (2013.01); *F02D 41/1456* (2013.01)

(58) Field of Classification Search
CPC ..... F02D 41/1495
See application file for complete search history.

(56) References Cited

U.S. PATENT DOCUMENTS 3,938,075 A * 2/1976 Reddy ..... F02D 41/1495 123/688
4,886,028 A 12/1989 Uchinami et al.
4,938,194 A 7/1990 Kato et al.
4,947,818 A * 8/1990 Kamohara ..... F02D 41/1441 123/198 D (Continued)

FOREIGN PATENT DOCUMENTS

EP 0811759 A2 12/1997
JP H01219328 A 9/1989

(Continued)

*Primary Examiner* — Lisa Caputo
*Assistant Examiner* — Alex Devito
(74) *Attorney, Agent, or Firm* — Hunton Andrews Kurth LLP

(57) ABSTRACT

An abnormality diagnosis system of an air-fuel ratio sensor 40 or 41 provided in an exhaust passage of an internal combustion engine and generating a limit current corresponding to an air-fuel ratio, comprises a current detecting part 61 detecting an output current of the air-fuel ratio sensor and an applied voltage control device 60 controlling a voltage applied to the air-fuel ratio sensor. The abnormality diagnosis system applies a voltage inside a limit current region where a limit current is generated and a voltage outside the limit current region to the air-fuel ratio sensor when the air-fuel ratio of the exhaust gas circulating around the air-fuel ratio sensor is made a predetermined constant air-fuel ratio, and judges a type of abnormality occurring at the air-fuel ratio sensor based on an output current of the air-fuel ratio sensor detected by the current detecting part at this time.

11 Claims, 12 Drawing Sheets

(56) References Cited

U.S. PATENT DOCUMENTS

| | | | | | |
|---|---|---|---|---|---|
| 5,230,320 | A | * | 7/1993 | Hitomi | F01L 1/26 123/308 |
| 5,709,198 | A | * | 1/1998 | Sagisaka | F02D 41/1455 123/684 |
| 5,769,063 | A | | 6/1998 | Mizusawa | |
| 5,781,878 | A | | 7/1998 | Mizoguchi et al. | |
| 5,845,489 | A | | 12/1998 | Dohta et al. | |
| 5,964,208 | A | * | 10/1999 | Yamashita | F02D 41/1456 123/674 |
| 2007/0006860 | A1 | | 1/2007 | Nakamura et al. | |
| 2015/0247434 | A1 | | 9/2015 | Hayashita et al. | |

FOREIGN PATENT DOCUMENTS

| | | | |
|---|---|---|---|
| JP | H01262460 | A | 10/1989 |
| JP | H0212049 | A | 1/1990 |
| JP | H09166569 | A | 6/1997 |
| JP | H10-62376 | A | 3/1998 |
| JP | 2000-055861 | A | 2/2000 |
| JP | 2001234805 | A | 8/2001 |
| JP | 2006077659 | A | 3/2006 |
| JP | 2007-017191 | A | 1/2007 |
| JP | 2007239491 | A | 9/2007 |
| JP | 2010-071259 | A | 4/2010 |
| JP | 2010-174790 | A | 8/2010 |
| JP | 2012068150 | A | 4/2012 |
| WO | 2014045367 | A1 | 3/2014 |

* cited by examiner

ABNORMALITY DIAGNOSIS SYSTEM OF AIR-FUEL RATIO SENSOR

CROSS-REFERENCE TO RELATED APPLICATION

The present application claims priority to Japanese Patent Application No. 2014-228870 filed on Nov. 11, 2014, which is incorporated herein by reference in its entirety.

TECHNICAL FIELD

The present invention relates to an abnormality diagnosis system of an air-fuel ratio sensor. The air-fuel ration sensor is arranged in an exhaust passage of an internal combustion engine.

BACKGROUND ART

In the past, in an internal combustion engine designed to control an air-fuel ratio to a target air-fuel ratio, it is known to arrange a limit current type air-fuel ratio sensor, in an engine exhaust passage, in order to generate a limit current corresponding to the air-fuel ratio. In such an internal combustion engine, the amount of fuel fed to a combustion chamber is controlled by feedback by the air-fuel ratio sensor so that the air-fuel ratio becomes the target air-fuel ratio. In this regard, sometimes this air-fuel ratio sensor has a cracked element resulting in the outer surface of the sensor element and the internal space of the sensor element ending up being communicated. If having such a cracked element, the air-fuel ratio sensor can no longer generate a suitable output corresponding to the air-fuel ratio. As a result, the air-fuel ratio can no longer be accurately controlled by feedback to the target air-fuel ratio.

Therefore, an abnormality diagnosis system for detecting a cracked element of an air-fuel ratio sensor has been known in the past (for example, PLT 1). According to PLT 1, usually the voltage applied to the air-fuel ratio sensor is set to a center of a limit current region. If the sensor element of the air-fuel ratio sensor has cracked or the platinum on the electrodes has shrunken, it is believed that the voltage applied to the air-fuel ratio sensor will deviate to the high voltage side from the center part of the limit current region. Therefore, in the system described in this PLT 1, when the voltage applied to the air-fuel ratio sensor deviates to the high voltage side or low voltage side from the center part of the limit current region, it is judged that the sensor element of the air-fuel ratio sensor has cracked or the platinum on the electrodes has shrunken.

CITATIONS LIST

Patent Literature

PLT 1. Japanese Patent Publication No. 2010-174790A
PLT 2. Japanese Patent Publication No. 10-062376A
PLT 3. Japanese Patent Publication No. 2007-017191A
PLT 4. Japanese Patent Publication No. 2000-55861A

SUMMARY OF INVENTION

Technical Problem

In this regard, various abnormalities may be mentioned as occurring at the air-fuel ratio sensor. As such abnormalities, for example, the diffusion regulation layer constituting the air-fuel ratio sensor clogging or otherwise degrading, a circuit connected to the air-fuel ratio sensor malfunctioning, etc. may be mentioned. Among these, if the diffusion regulation layer clogs or otherwise deteriorates, the change of the output current of the air-fuel ratio sensor deviates from the change of the air-fuel ratio of the exhaust gas around the air-fuel ratio sensor, that is, "slope type deviation" occurs. On the other hand, if a circuit connected to the air-fuel ratio sensor malfunctions, the output current of the air-fuel ratio sensor deviates overall from the air-fuel ratio of the exhaust gas around the air-fuel ratio sensor by a constant value, that is, "offset type deviation" occurs. However, in the conventional method of detection of abnormality, even if it was possible to detect deviation in the air-fuel ratio sensor, it was not possible to differentiate whether this was slope type deviation or offset type deviation. That is, it was not possible to differentiate the type of abnormality occurring in the air-fuel ratio sensor.

Therefore, in consideration of the above problem, an object of the present invention is to provide a system for detecting abnormality able to differentiate a type of abnormality occurring at an air-fuel ratio sensor.

Solution to Problem

In order to solve the above problem, in a first invention, there is provided an abnormality diagnosis system of an air-fuel ratio sensor provided in an exhaust passage of an internal combustion engine and generating a limit current corresponding to an air-fuel ratio, wherein the system comprises a current detecting part detecting an output current of the air-fuel ratio sensor and an applied voltage control device controlling a voltage applied to the air-fuel ratio sensor, the system applies a voltage inside a limit current region where a limit current is generated and a voltage outside the limit current region to the air-fuel ratio sensor when the air-fuel ratio of the exhaust gas circulating around the air-fuel ratio sensor is made a predetermined constant air-fuel ratio, and judges a type of abnormality occurring at the air-fuel ratio sensor based on an output current of the air-fuel ratio sensor detected by the current detecting part at this time.

In a second invention, the voltage outside the limit current region is a voltage lower than the limit current region and inside a proportional region where the output current rises along with a rise of applied voltage in a first invention.

In a third invention, an output current when applying the voltage inside the limit current region to the air-fuel ratio sensor and an output current when applying the voltage outside the limit current region to the air-fuel ratio sensor in the state where the air-fuel ratio of the exhaust gas circulating around the air-fuel ratio sensor is maintained at the predetermined constant air-fuel ratio when the air-fuel ratio sensor is normal are respectively detected or calculated in advance as a normal value inside the limit current region and a normal value outside the limit current region, and the type of abnormality occurring at the air-fuel ratio sensor is judged based on the differences between detected values of the output currents of the air-fuel ratio sensor when applying the voltage inside the limit current region and the voltage outside the limit current to the air-fuel ratio sensor in the state where the air-fuel ratio of the exhaust gas circulating around the air-fuel ratio sensor is maintained at the predetermined constant air-fuel ratio, and the normal value inside the limit current region and normal value outside the limit current region in the first or second invention.

In a forth invention, when the difference between the detected value of the output current of the air-fuel ratio sensor when applying a voltage inside the limit current region to the air-fuel ratio sensor in the state where the air-fuel ratio of the exhaust gas circulating around the air-fuel ratio sensor is maintained at the predetermined constant air-fuel ratio and the normal value inside the limit current region is a predetermined reference value inside the limit current region or more, and the difference between the detected value of the output current of the air-fuel ratio sensor when applying a voltage outside the limit current region to the air-fuel ratio sensor in the state where the air-fuel ratio of the exhaust gas circulating around the air-fuel ratio sensor is maintained at the predetermined constant air-fuel ratio and the normal value outside the limit current region is a predetermined reference value outside the limit current region or more, it is judged that an offset type deviation where the output current of the air-fuel ratio sensor is deviated overall from the air-fuel ratio of the exhaust gas circulating around the air-fuel ratio sensor has occurred at the air-fuel ratio sensor in the third invention.

In a fifth invention, when the difference between the detected value of the output current of the air-fuel ratio sensor when applying a voltage inside the limit current region to the air-fuel ratio sensor in the state where the air-fuel ratio of the exhaust gas circulating around the air-fuel ratio sensor is maintained at the predetermined constant air-fuel ratio and the normal value inside the limit current region is a predetermined reference value inside the limit current region or more, and the difference between the detected value of the output current of the air-fuel ratio sensor when applying a voltage outside the limit current region to the air-fuel ratio sensor in the state where the air-fuel ratio of the exhaust gas circulating around the air-fuel ratio sensor is maintained at the predetermined constant air-fuel ratio and the normal value outside the limit current region is less than a predetermined reference value outside the limit current region or more, it is judged that a slope type deviation where the change of the output current of the air-fuel ratio sensor is deviated from the change of the air-fuel ratio of the exhaust gas circulating around the air-fuel ratio sensor has occurred at the air-fuel ratio sensor in third or fourth invention.

In a sixth invention, the internal combustion engine comprises an exhaust purification catalyst arranged in the exhaust passage, an upstream side air-fuel ratio sensor arranged at an upstream side of the exhaust purification catalyst in the direction of exhaust flow in the exhaust passage, and a downstream side air-fuel ratio sensor arranged at a downstream side of the exhaust purification catalyst in the direction of exhaust flow in the exhaust passage and wherein the downstream side air-fuel ratio sensor is comprised of the limit current type air-fuel ratio sensor in any one of the first to fifth inventions.

In a seventh invention, the internal combustion engine comprises an exhaust purification catalyst arranged in the exhaust passage, an upstream side air-fuel ratio sensor arranged at an upstream side of the exhaust purification catalyst in the direction of exhaust flow in the exhaust passage, and a downstream side air-fuel ratio sensor arranged at a downstream side of the exhaust purification catalyst in the direction of exhaust flow in the exhaust passage and wherein the upstream side air-fuel ratio sensor is comprised of the limit current type air-fuel ratio sensor in any one of the first to fifth inventions.

In an eighth invention, the internal combustion engine can carry out fuel cut control wherein feed of fuel to a combustion chamber is stopped during operation of the internal combustion engine, and the time when the air-fuel ratio of the exhaust gas circulating around the air-fuel ratio sensor is maintained at the predetermined constant air-fuel ratio is during the fuel cut control in any one of the first to seventh inventions.

In a ninth invention, the internal combustion engine can carry out fuel cut control wherein feed of fuel to a combustion chamber is stopped during operation of the internal combustion engine as fuel cut control and, post-reset rich control wherein the air-fuel ratio of the exhaust gas flowing into the exhaust purification catalyst is made a rich air-fuel ratio richer than the stoichiometric air-fuel ratio after the end of the fuel cut control, and the time when the air-fuel ratio of the exhaust gas circulating around the air-fuel ratio sensor is maintained at the predetermined constant air-fuel ratio is during the post-reset rich control in the seventh invention.

In a tenth invention, the internal combustion engine performs feedback control so that the output air-fuel ratio of the upstream side air-fuel ratio sensor becomes a target air-fuel ratio, and the time when the air-fuel ratio of the exhaust gas circulating around the air-fuel ratio sensor is maintained at the predetermined constant air-fuel ratio is the time when the target air-fuel ratio is maintained constant at a predetermined air-fuel ratio in the seventh invention.

In an eleventh invention, the internal combustion engine performs feedback control so that the output air-fuel ratio of the upstream side air-fuel ratio sensor becomes a target air-fuel ratio, and the time when the air-fuel ratio of the exhaust gas circulating around the air-fuel ratio sensor is maintained at the predetermined constant air-fuel ratio is the time when the target air-fuel ratio is alternately changed between a rich air-fuel ratio richer than the stoichiometric air-fuel ratio and a lean air-fuel ratio leaner than the stoichiometric air-fuel ratio so that an oxygen storage amount of the exhaust purification catalyst is maintained at an amount greater than zero and less than the maximum storable amount of oxygen in the seventh invention.

Advantageous Effects of Invention

According to the present invention, it is possible to provide a system for detecting abnormality able to differentiate a type of abnormality occurring at an air-fuel ratio sensor.

DESCRIPTION OF EMBODIMENTS

Figure 1:
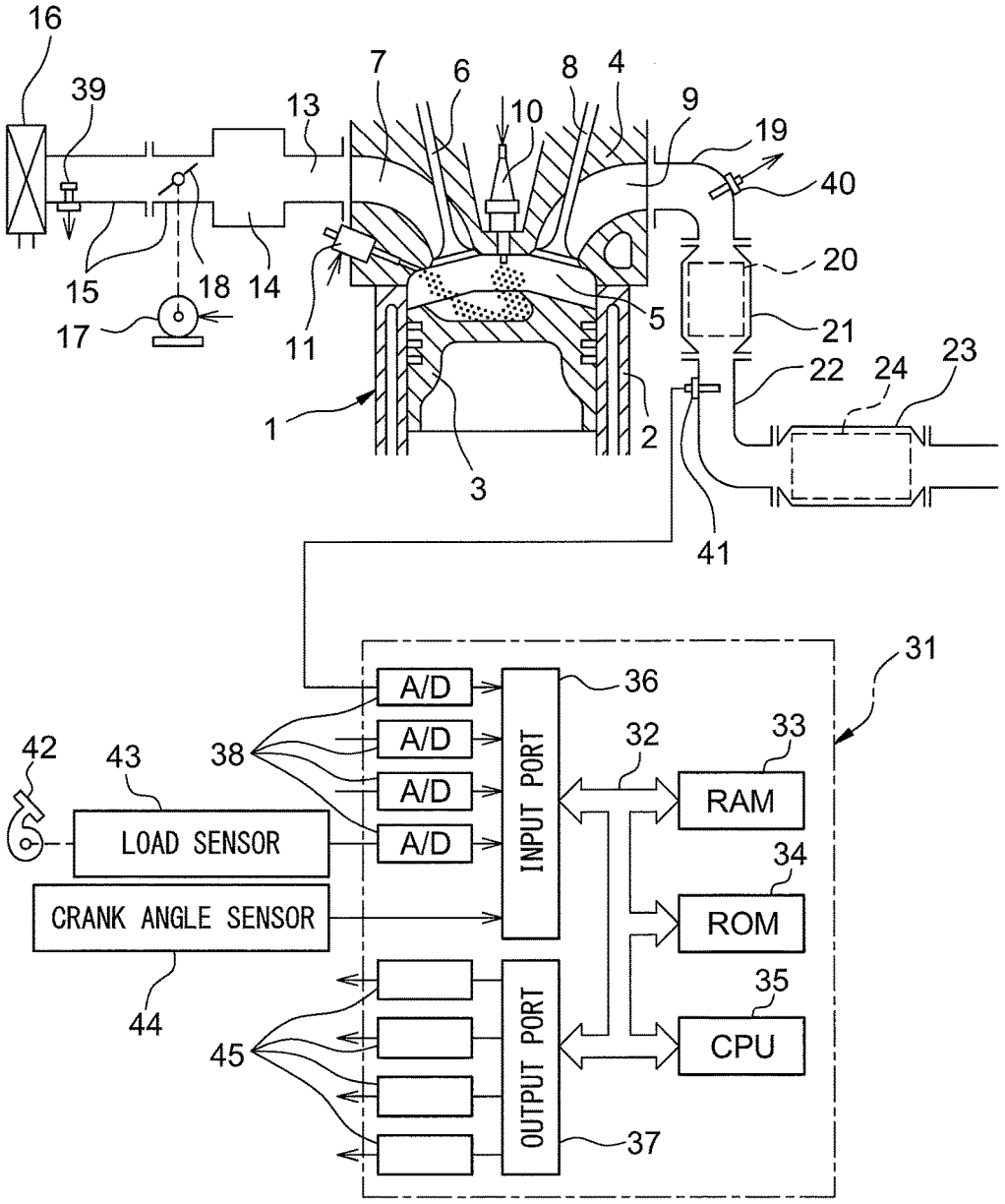
FIG. 1 is a view schematically showing an internal combustion engine in which an abnormality diagnosis system of the present invention is used.

Referring to the drawings, an embodiment of the present invention will be explained in detail below. Note that, in the following explanation, similar component elements are assigned the same reference numerals.

<Explanation of Internal Combustion Engine as a Whole>

FIG. 1 is a view which schematically shows an internal combustion engine in which an abnormality diagnosis system according to a first embodiment of the present invention is used. Referring to FIG. 1, 1 indicates an engine body, 2 a cylinder block, 3 a piston which reciprocates inside the cylinder block 2, 4 a cylinder head which is fastened to the cylinder block 2, 5 a combustion chamber which is formed between the piston 3 and the cylinder head 4, 6 an intake valve, 7 an intake port, 8 an exhaust valve, and 9 an exhaust port. The intake valve 6 opens and closes the intake port 7, while the exhaust valve 8 opens and closes the exhaust port 9.

As shown in FIG. 1, a spark plug 10 is arranged at a center part of an inside wall surface of the cylinder head 4, while a fuel injector 11 is arranged at a side part of the inner wall surface of the cylinder head 4. The spark plug 10 is configured to generate a spark in accordance with an ignition signal. Further, the fuel injector 11 injects a predetermined amount of fuel into the combustion chamber 5 in accordance with an injection signal. Note that, the fuel injector 11 may also be arranged so as to inject fuel into the intake port 7. Further, in the present embodiment, as the fuel, gasoline with a stoichiometric air-fuel ratio of 14.6 is used. However, the internal combustion engine using the abnormality diagnosis system of the present invention may also use fuel other than gasoline, or mixed fuel with gasoline.

The intake port 7 of each cylinder is connected to a surge tank 14 through a corresponding intake runner 13, while the surge tank 14 is connected to an air cleaner 16 through an intake pipe 15. The intake port 7, intake runner 13, surge tank 14, and intake pipe 15 form an intake passage. Further, inside the intake pipe 15, a throttle valve 18 which is driven by a throttle valve drive actuator 17 is arranged. The throttle valve 18 can be operated by the throttle valve drive actuator 17 to thereby change the aperture area of the intake passage.

On the other hand, the exhaust port 9 of each cylinder is connected to an exhaust manifold 19. The exhaust manifold 19 has a plurality of runners which are connected to the exhaust ports 9 and a header at which these runners are collected. The header of the exhaust manifold 19 is connected to an upstream side casing 21 which houses an upstream side exhaust purification catalyst 20. The upstream side casing 21 is connected through an exhaust pipe 22 to a downstream side casing 23 which houses a downstream side exhaust purification catalyst 24. The exhaust port 9, exhaust manifold 19, upstream side casing 21, exhaust pipe 22, and downstream side casing 23 form an exhaust passage.

The electronic control unit (ECU) 31 is comprised of a digital computer which is provided with components which are connected together through a bidirectional bus 32 such as a RAM (random access memory) 33, ROM (read only memory) 34, CPU (microprocessor) 35, input port 36, and output port 37. In the intake pipe 15, an air flow meter 39 is arranged for detecting the flow rate of air which flows through the intake pipe 15. The output of this air flow meter 39 is input through a corresponding AD converter 38 to the input port 36. Further, at the header of the exhaust manifold 19, an upstream side air-fuel ratio sensor 40 is arranged which detects the air-fuel ratio of the exhaust gas which flows through the inside of the exhaust manifold 19 (that is, the exhaust gas which flows into the upstream side exhaust purification catalyst 20). In addition, in the exhaust pipe 22, a downstream side air-fuel ratio sensor 41 is arranged which detects the air-fuel ratio of the exhaust gas which flows through the inside of the exhaust pipe 22 (that is, the exhaust gas which flows out from the upstream side exhaust purification catalyst 20 and flows into the downstream side exhaust purification catalyst 24). The outputs of these air-fuel ratio sensors 40 and 41 are also input through the corresponding AD converters 38 to the input port 36. Note that, the configurations of these air-fuel ratio sensors 40 and 41 will be explained later.

Further, an accelerator pedal 42 has a load sensor 43 connected to it which generates an output voltage which is proportional to the amount of depression of the accelerator pedal 42. The output voltage of the load sensor 43 is input to the input port 36 through a corresponding AD converter 38. The crank angle sensor 44 generates an output pulse every time, for example, a crankshaft rotates by 15 degrees. This output pulse is input to the input port 36. The CPU 35 calculates the engine speed from the output pulse of this crank angle sensor 44. On the other hand, the output port 37 is connected through corresponding drive circuits 45 to the spark plugs 10, fuel injectors 11, and throttle valve drive actuator 17. Note that, ECU 31 acts as abnormality diagnosis system for diagnosing abnormality of the downstream side air-fuel ratio sensor 41.

The upstream side exhaust purification catalyst 20 and the downstream side exhaust purification catalyst 24 are three-way catalysts which has an oxygen storage ability. Specifically, the upstream side exhaust purification catalyst 20 and the downstream side exhaust purification catalyst 24 are formed from three-way catalysts which comprises a carrier made of ceramic on which a precious metal (for example, platinum Pt) having catalystic action and a substance which has an oxygen storage ability (for example, ceria $CeO_2$) are carried. A three-way catalyst has the function of simultaneously purifying unburned HC, CO and $NO_x$ when the air-fuel ratio of the exhaust gas flowing into the three-way catalyst is maintained at the stoichiometric air-fuel ratio. In addition, when the exhaust purification catalysts 20 and 24 have an oxygen storage ability, the unburned HC and CO and $NO_x$ are simultaneously purified even if the air-fuel ratio of the exhaust gas flowing into the exhaust purification catalysts 20 and 24 somewhat deviates from the stoichiometric air-fuel ratio to the rich side or lean side.

That is, if the exhaust purification catalysts 20 and 24 have an oxygen storage ability, when the air-fuel ratio of the exhaust gas flowing into the exhaust purification catalysts 20, 24 becomes somewhat lean with respect to the stoichiometric air-fuel ratio, the excess oxygen contained in the exhaust gas is stored in the exhaust purification catalysts 20, 24 and thus the surfaces of the exhaust purification catalysts 20 and 24 are maintained at the stoichiometric air-fuel ratio. As a result, on the surfaces of the exhaust purification catalysts 20 and 24, the unburned HC, CO and $NO_x$ are simultaneously purified. At this time, the air-fuel ratio of the exhaust gas flowing out from the exhaust purification catalysts 20 and 24 becomes the stoichiometric air-fuel ratio.

Alternatively, when the air-fuel ratio of the exhaust gas flowing into the exhaust purification catalysts 20, 24 becomes somewhat rich with respect to the stoichiometric air-fuel ratio, the oxygen, which is insufficient for reducing the unburned HC and CO which are contained in the exhaust gas, is released from the exhaust purification catalysts 20 and 24. In this case as well, the surfaces of the exhaust purification catalysts 20 and 24 are maintained at the stoichiometric air-fuel ratio. As a result, at the surfaces of the exhaust purification catalysts 20 and 24, unburned HC, CO and $NO_x$ are simultaneously purified. At this time, the air-fuel ratio of the exhaust gas flowing out from the exhaust purification catalysts 20 and 24 becomes the stoichiometric air-fuel ratio.

In this way, when the exhaust purification catalysts 20 and 24 have an oxygen storage ability, even if the air-fuel ratio of the exhaust gas flowing into the exhaust purification catalysts 20 and 24 deviates somewhat from the stoichiometric air-fuel ratio to the rich side or lean side, the unburned HC, CO and $NO_x$ are simultaneously purified and the air-fuel ratio of the exhaust gas flowing out from the exhaust purification catalysts 20 and 24 becomes the stoichiometric air-fuel ratio.

<Explanation of Air-Fuel Ratio Sensor>

Figure 2:
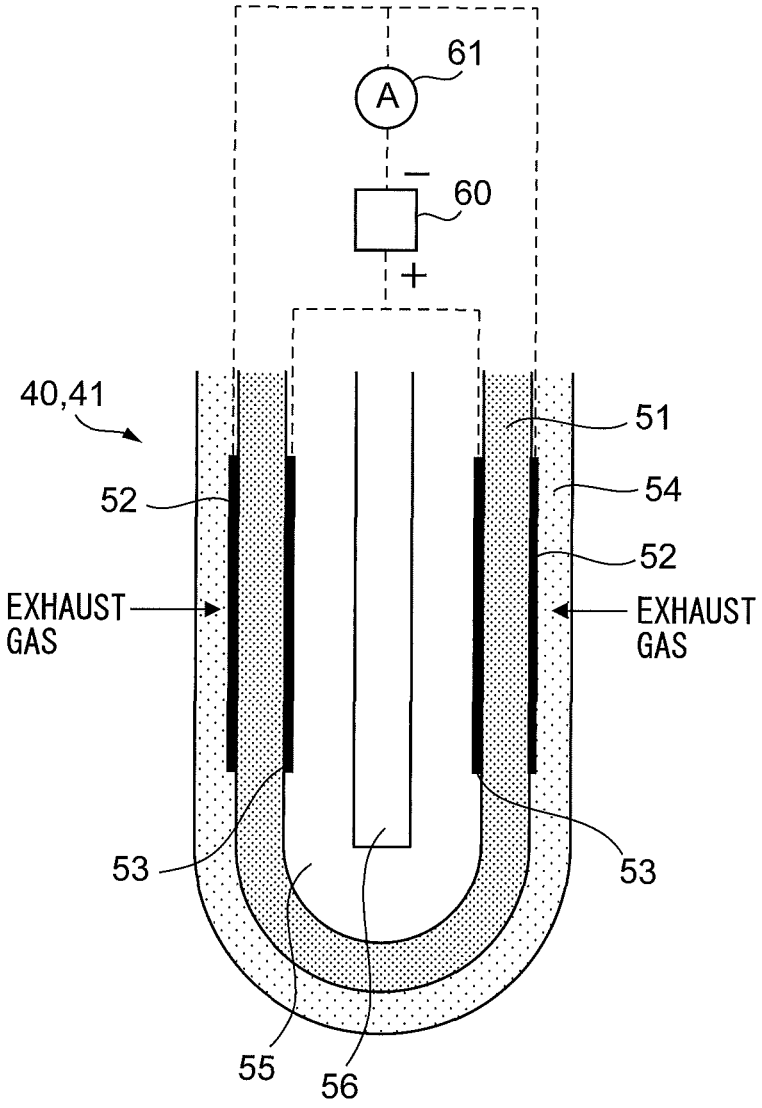
FIG. 2 is a schematic cross-sectional view of an air-fuel ratio sensor.

In the present embodiment, as the air-fuel ratio sensors 40 and 41, cup type limit current type air-fuel ratio sensors are used. FIG. 2 will be used to simply explain the structures of the air-fuel ratio sensors 40 and 41. Each of the air-fuel ratio sensors 40 and 41 is provided with a solid electrolyte layer 51, an exhaust side electrode 52 which is arranged on one side surface of the solid electrolyte layer 51, an atmosphere side electrode 53 which is arranged on the other side surface of the solid electrolyte layer 51, a diffusion regulation layer 54 which regulates the diffusion of the flowing exhaust gas, a reference gas chamber 55, and a heater part 56 which heats the air-fuel ratio sensor 40 or 41, in particular, heats the solid electrolyte layer 51.

In particular, in each of the cup type air-fuel ratio sensors 40 and 41 of the present embodiment, the solid electrolyte layer 51 is formed into a cylindrical shape with one closed end. Inside of the reference gas chamber 55 which is defined inside of the solid electrolyte layer 51, atmospheric gas (air) is introduced and the heater part 56 is arranged. On the inside surface of the solid electrolyte layer 51, an atmosphere side electrode 53 is arranged. On the outside surface of the solid electrolyte layer 51, an exhaust side electrode 52 is arranged. On the outside surfaces of the solid electrolyte layer 51 and the exhaust side electrode 52, a diffusion regulation layer 54 is arranged to cover the outside surfaces. Note that, at the outside of the diffusion regulation layer 54, a protective layer (not shown) may be provided for preventing a liquid, etc. from depositing on the surface of the diffusion regulation layer 54.

The solid electrolyte layer 51 is formed by a sintered body of $ZrO_2$ (zirconia), $HfO_2$, $ThO_2$, $Bi_2O_3$, or other oxygen ion conducting oxide in which CaO, MgO, $Y_2O_3$, $Yb_2O_3$, etc. is blended as a stabilizer. Further, the diffusion regulation layer 54 is formed by a porous sintered body of alumina, magnesia, silica, spinel, mullite, or another heat resistant inorganic substance. Furthermore, the exhaust side electrode 52 and atmosphere side electrode 53 are formed by platinum or other precious metal with a high catalytic activity.

Further, between the exhaust side electrode 52 and the atmosphere side electrode 53, sensor applied voltage V is supplied by the voltage control device 60 which is mounted on the ECU 31. In addition, the ECU 31 is provided with a current detection part 61 which detects the current I which flows between these electrodes 52 and 53 through the solid electrolyte layer 51 when sensor applied voltage V is supplied. The current which is detected by this current detection part 61 is the output current I of the air-fuel ratio sensors 40 and 41.

Figure 3:
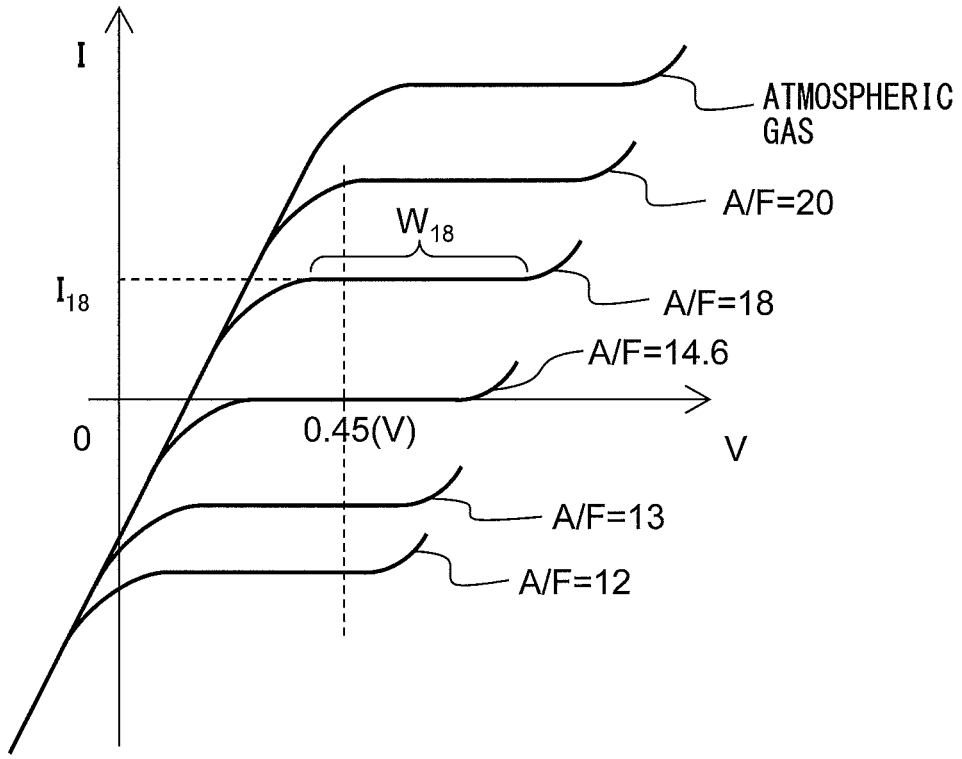
FIG. 3 is a view showing a relationship between an applied voltage V and an output current I at different exhaust air-fuel ratios A/F.

The thus configured air-fuel ratio sensors 40 and 41 have the voltage-current (V-I) characteristic such as shown in FIG. 3. As will be understood from FIG. 3, the higher (the leaner) the air-fuel ratio of the exhaust gas, i.e., the exhaust air-fuel ratio A/F, the output current I of the air-fuel ratio sensors 40 and 41 becomes larger. Further, at the line V-I of each exhaust air-fuel ratio A/F, there is a region parallel to the sensor applied voltage V axis, that is, a region where the output current I does not change much at all even if the sensor applied voltage V changes. This voltage region is called the "limit current region". The current at this time is called the "limit current". In FIG. 3, the limit current region and limit current when the exhaust air-fuel ratio is 18 are shown by $W_{18}$ and $I_{18}$.

On the other hand, in the region where the sensor applied voltage is lower than the limit current region, the output current rises substantially proportionally along with the rise of the sensor applied voltage. Such a region is called a "proportional region". The slope at this time is determined by the DC element resistance of the solid electrolyte layer 51. Further, in the region where the sensor applied voltage is higher than the limit current region, the output current also increases along with the increase in the sensor applied voltage. In this region, the output voltage changes according to the change in sensor applied voltage due to the breakdown of moisture contained in the exhaust gas at the exhaust side electrode 52 etc.

Figure 4:
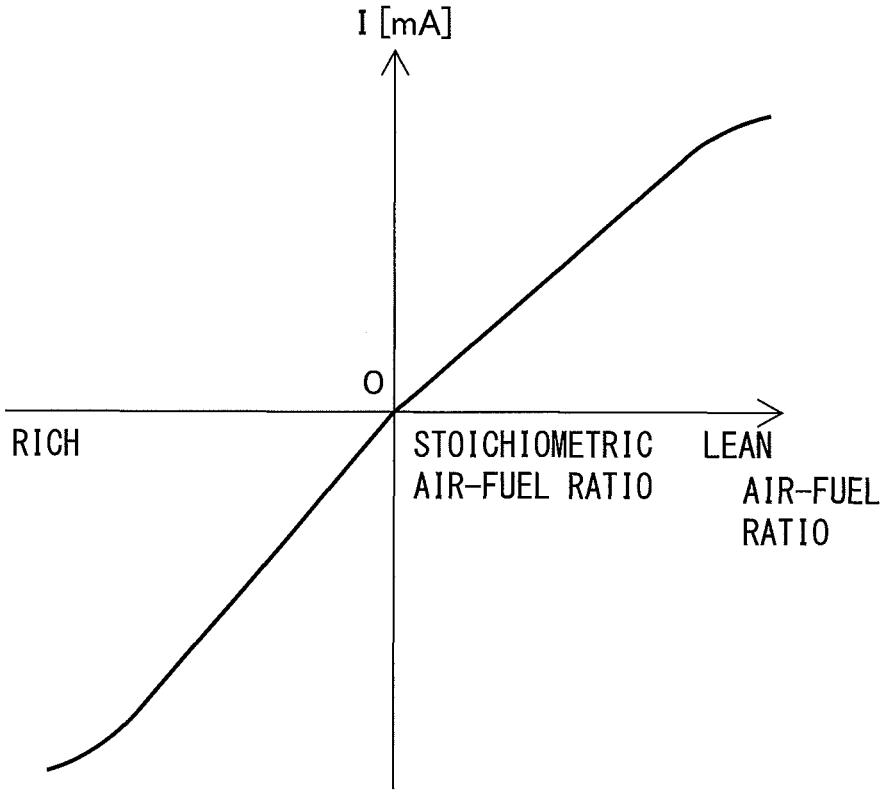
FIG. 4 is a view showing a relationship between an air-fuel ratio and an output current I when making an applied voltage V constant.

FIG. 4 shows the relationship between the exhaust air-fuel ratio and the output current I when making the applied voltage V constant at about 0.45V (FIG. 3). As will be understood from FIG. 4, in the air-fuel ratio sensors 40 and 41, the output current changes linearly (proportionally) changes with respect to the exhaust air-fuel ratio so that the higher (that is, the leaner) the exhaust air-fuel ratio, the greater the output current I from the air-fuel ratio sensors 40 and 41. In addition, the air-fuel ratio sensors 40 and 41 are configured so that the output current I becomes zero when the exhaust air-fuel ratio is the stoichiometric air-fuel ratio.

Note that, as the air-fuel ratio sensors 40 and 41, instead of the limit current type air-fuel ratio sensor having the structure shown in FIG. 2, it is also possible to use a layered-type limit current type air-fuel ratio sensor.

<Basic Control>

In the thus configured internal combustion engine, the amount of fuel injection from the fuel injector 11 is set based on the outputs of the upstream side air-fuel ratio sensor 40 and the downstream side air-fuel ratio sensor 41 so that the air-fuel ratio of the exhaust gas flowing into the upstream side exhaust purification catalyst 20 becomes the optimal air-fuel ratio based on the engine operating state. As such a method of setting the amount of fuel injection, the method may be mentioned of controlling the air-fuel ratio of the exhaust gas flowing into the upstream side exhaust purification catalyst 20 (or the target air-fuel ratio of the exhaust gas flowing out from the engine body) by feedback based on the output of the upstream side air-fuel ratio sensor 40 to become the target air-fuel ratio and correcting the output of the upstream side air-fuel ratio sensor 40 or changing the target air-fuel ratio etc. based on the output of the downstream side air-fuel ratio sensor 41.

Figure 5:
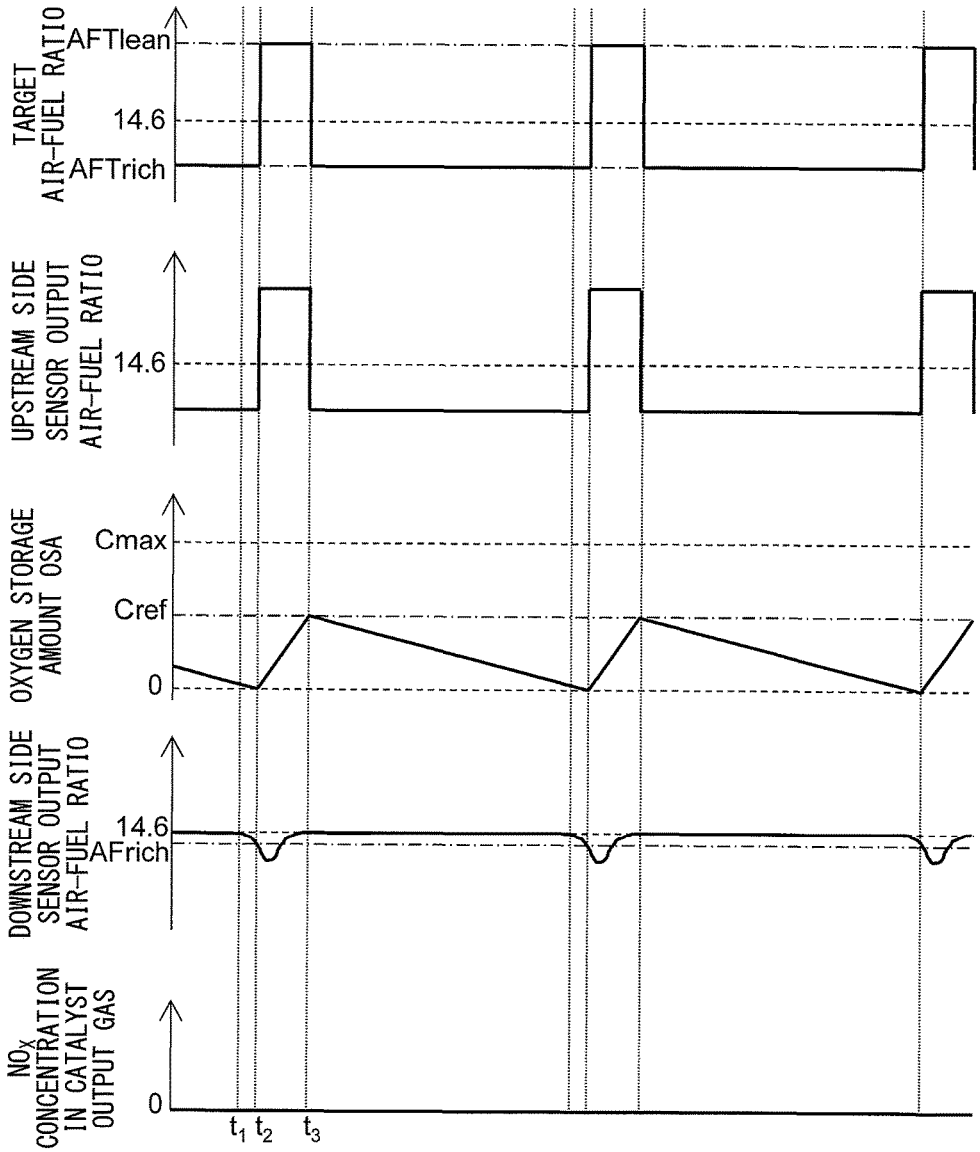
FIG. 5 is a time chart showing a change of an oxygen storage amount of an upstream side exhaust purification catalyst etc. at the time of normal operation of an internal combustion engine.

Referring to FIG. 5, an example of such a control of the target air-fuel ratio will be simply explained. FIG. 5 is a time chart of the oxygen storage amount of the upstream side exhaust purification catalyst, the target air-fuel ratio, the output air-fuel ratio of the upstream side air-fuel ratio sensor, and the output air-fuel ratio of the downstream side air-fuel ratio sensor at the time of normal operation of the internal combustion engine. Note that, the "output air-fuel ratio" means the air-fuel ratio corresponding to the output of the air-fuel ratio sensor. Further, "at the time of normal operation" means the operating state (control state) when not performing control for adjusting the amount of fuel injection corresponding to a specific operating state of the internal combustion engine (for example, control for increasing the amount of fuel injection at the time of acceleration of a vehicle mounting an internal combustion engine or fuel cut control for stopping the feed of fuel to a combustion chamber etc.

In the example shown in FIG. 5, when the output air-fuel ratio of the downstream side air-fuel ratio sensor 41 is a rich judged air-fuel ratio AFrich (for example, 14.55) or less, the target air-fuel ratio is set to and maintained at a lean set air-fuel ratio AFTlean (for example, 15). After that, the oxygen storage amount of the upstream side exhaust purification catalyst 20 is estimated. When this estimated value becomes a predetermined judged reference storage amount Cref (amount smaller than maximum oxygen storage amount Cmax) or more, the target air-fuel ratio is set to and maintained at a rich set air-fuel ratio AFTrich (for example, 14.4). In the example shown in FIG. 5, such an operation is repeated.

Specifically, in the example shown in FIG. 5, before the time $t_1$, the target air-fuel ratio is made a rich set air-fuel ratio AFTrich. Along with this, the output air-fuel ratio of the upstream side air-fuel ratio sensor 40 also becomes an air-fuel ratio richer than the stoichiometric air-fuel ratio (below, "rich air-fuel ratio"). Further, the upstream side exhaust purification catalyst 20 stores oxygen, therefore the output air-fuel ratio of the downstream side air-fuel ratio sensor 41 becomes a substantially stoichiometric air-fuel ratio (14.6). At this time, the air-fuel ratio of the exhaust gas flowing into the upstream side exhaust purification catalyst 20 becomes a rich air-fuel ratio; therefore the oxygen storage amount of the upstream side exhaust purification catalyst 20 gradually falls.

After this, at the time $t_1$, by the oxygen storage amount of the upstream side exhaust purification catalyst 20 approaching zero, part of the unburned gas (unburned HC and CO) flowing into the upstream side exhaust purification catalyst 20 starts to flow out without being removed by the upstream side exhaust purification catalyst 20. As a result, at the time $t_2$, the output air-fuel ratio of the downstream side air-fuel ratio sensor 41 becomes a rich judged air-fuel ratio AFrich slightly richer than the stoichiometric air-fuel ratio. At this time, the target air-fuel ratio is switched from a rich set air-fuel ratio AFTrich to a lean set air-fuel ratio AFTlean.

By switching the target air-fuel ratio, the air-fuel ratio of the exhaust gas flowing into the upstream side exhaust purification catalyst 20 becomes an air-fuel ratio leaner than the stoichiometric air-fuel ratio (below, referred to as "lean air-fuel ratio") and the outflow of unburned gas decreases and stops. Further, the oxygen storage amount of the upstream side exhaust purification catalyst 20*b* gradually increases and, at the time $t_3$, reaches a judged reference storage amount Cref. In this way when the oxygen storage amount reaches a judged reference storage amount Cref, the target air-fuel ratio is again switched from a lean set air-fuel ratio AFlean to a rich set air-fuel ratio AFTrich. By switching the target air-fuel ratio, the air-fuel ratio of the exhaust gas flowing into the upstream side exhaust purification catalyst 20 again becomes a rich air-fuel ratio. As a result, the oxygen storage amount of the upstream side exhaust purification catalyst 20 gradually decreases. Afterward, such an operation is repeatedly performed. By performing such control, it is possible to prevent outflow of $NO_x$ from the upstream side exhaust purification catalyst 20.

Note that, the control of the target air-fuel ratio based on the outputs of the upstream side air-fuel ratio sensor 40 and the downstream side air-fuel ratio sensor 41 performed as normal control is not limited to the above-mentioned such control. So long as control based on output of these air-fuel ratio sensors 40 and 41, any control is possible. Therefore, for example, as normal control, it is also possible to fix the target air-fuel ratio at the stoichiometric air-fuel ratio, control the output air-fuel ratio of the upstream side air-fuel ratio sensor 40 by feedback to become the stoichiometric air-fuel ratio, and correct the output air-fuel ratio of the upstream side air-fuel ratio sensor 40 based on the output air-fuel ratio of the downstream side air-fuel ratio sensor 41.

<Problems in Diagnosis of Abnormality of Air-Fuel Ratio Sensor>

Figure 6:
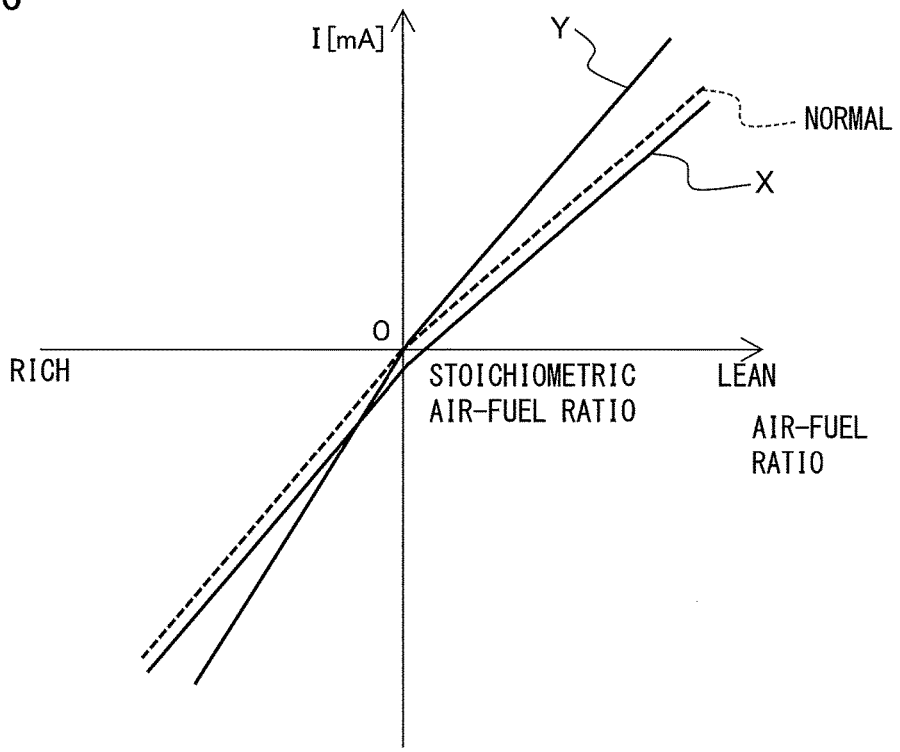
FIG. 6 is a view showing a relationship between an exhaust air-fuel ratio and an output current of an air-fuel ratio sensor in the cases where an air-fuel ratio sensor is normal and where it is abnormal.

In this regard, various abnormalities of output may arise in the air-fuel ratio sensors 40 and 41. As such abnormalities of output, for example, the ones mentioned in FIG. 6 may be mentioned. FIG. 6 shows the relationship between the exhaust air-fuel ratio and the output current of an air-fuel ratio sensor 40 or 41 in the case where the air-fuel ratio sensor 40 or 41 is normal and the case where it is abnormal. The broken line in FIG. 6 shows the relationship in the case where the air-fuel ratio sensor 40 or 41 is not abnormal. On the other hand, the solid line in FIG. 6 shows the case where the air-fuel ratio sensor 40 or 41 is abnormal.

In the case shown in FIG. 6 by X, in the entire region of the exhaust air-fuel ratio, deviation where the output current of the air-fuel ratio sensor 40 or 41 becomes a smaller value (or larger value) than a suitable value, that is, an offset type deviation, occurs. Therefore, in this case, the output current I of the air-fuel ratio sensor 40 or 41 indicates an air-fuel ratio at the rich side (or lean side) from the actual air-fuel ratio in the entire region. On the other hand, in the case shown in FIG. 6 by Y, the degree of change of the output current I of the air-fuel ratio sensor 40 or 41 with respect to the change of the exhaust air-fuel ratio becomes larger (or smaller) than a suitable value, that is, a slope type deviation occurs. That is, the slope of the output current I to the exhaust air-fuel ratio in the example shown in FIG. 6 by Y becomes a value larger than the slope at a normal air-fuel ratio sensor 40 or 41. Therefore, in this case, the absolute value of the output current of an air-fuel ratio sensor 40 or 41 indicates a rich degree or lean degree larger (or smaller) than the rich degree or lean degree of the actual air-fuel ratio.

Here, when performing normal control such as shown in FIG. 5, it is important that the upstream side air-fuel ratio sensor 40 can accurately detect if the air-fuel ratio of the exhaust gas flowing into the upstream side exhaust purification catalyst 20 is a rich air-fuel ratio or a lean air-fuel ratio. This is because if the target air-fuel ratio is a rich air-fuel ratio, but the actual air-fuel ratio of the exhaust gas flowing into the upstream side exhaust purification catalyst 20 is a lean air-fuel ratio, the normal control such as shown in FIG. 5 no longer works. Similarly, it is important that the downstream side air-fuel ratio sensor 41 can detect if the air-fuel ratio of the exhaust gas flowing out from the upstream side exhaust purification catalyst 20 is near the stoichiometric air-fuel ratio or is a rich air-fuel ratio or lean air-fuel ratio. This is because regardless of the actual air-fuel ratio of the exhaust gas flowing out from the upstream side exhaust purification catalyst 20 being the stoichiometric air-fuel ratio, if the air-fuel ratio detected by the downstream side air-fuel ratio sensor 41 becomes a rich air-fuel ratio, the normal control such as shown in FIG. 5 no longer works.

Therefore, at the time of normal control, rather than what extent the rich degree or lean degree of the exhaust air-fuel ratio is at the upstream side and downstream side of the upstream side exhaust purification catalyst 20, it is necessary to accurately detect if the exhaust air-fuel ratio is richer than or leaner than the stoichiometric air-fuel ratio. For this reason, if the offset type deviation shown in FIG. 6 by X occurs, deviation occurs in the output current at the stoichiometric air-fuel ratio, therefore it becomes necessary to detect abnormality even if the deviation is slight. However, if trying to detect offset type deviation even if the deviation is slight, there are not only cases where offset type deviation occurs, but also cases where it ends up being judged that offset type deviation has occurred even when a slope type deviation such as shown in FIG. 6 has occurred. Therefore, if diagnosing abnormality of the air-fuel ratio sensor 40 or 41 only based on the relationship between the exhaust air-fuel ratio and the output current I, sometimes the type of abnormality occurring (mode of abnormality) cannot be accurately specified.

<Characteristic of Abnormality in Air-Fuel Ratio Sensor>

Figure 7:
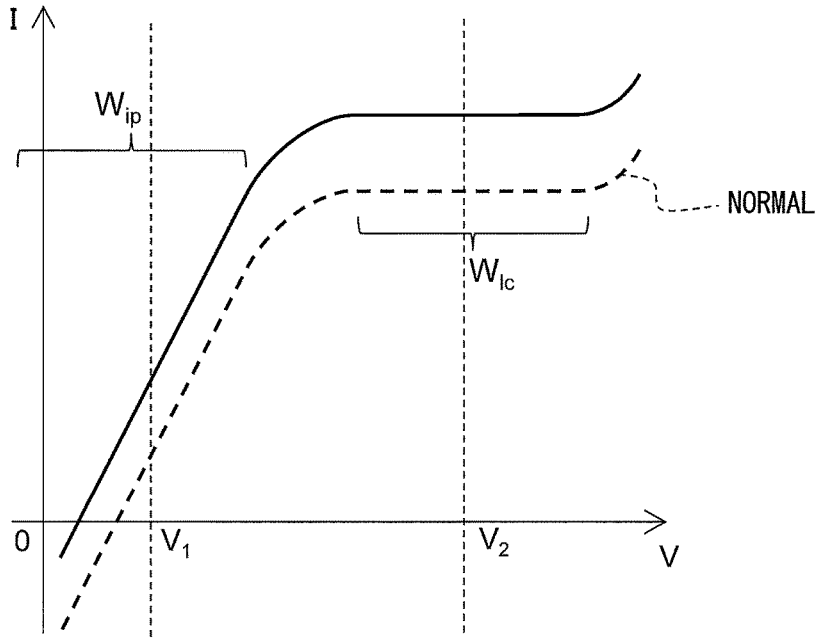
FIG. 7 is a view showing a relationship between a voltage applied to an air-fuel ratio sensor and an output current.

In this regard, the relationship between the voltage V applied to an air-fuel ratio sensor 40 or 41 and the output current I changes depending on the type of abnormality occurring at the air-fuel ratio sensor 40 or 41. FIG. 7 shows the relationship the voltage V applied to the air-fuel ratio sensor 40 or 41 and the output current I in the state where atmospheric gas circulates around the air-fuel ratio sensor 40 or 41 (that is, the state where exhaust gas of an air-fuel ratio corresponding to the atmospheric gas circulates). In FIG. 7, the solid line shows the relationship in the case where a circuit of the applied voltage control device 60 or current detecting part 61 etc. of the air-fuel ratio sensor 40 or 41 has become abnormal. On the other hand, in FIG. 7, the broken line shows the relationship in the case where the air-fuel ratio sensor 40 or 41 does not become abnormal, that is, the normal case.

As shown in FIG. 7, if a circuit etc. of an air-fuel ratio sensor 40 or 41 is abnormal, the output current I rises by exactly a constant value over the entire region of the applied voltage V compared with the normal case. As a result, if applying an applied voltage $V_2$ inside the limit current region Wlc to the air-fuel ratio sensor 40 or 41, the output current I at the time when the air-fuel ratio sensor 40 or 41 becomes abnormal rises from the output current I at the time when it is normal by exactly a constant value. Similarly, even if applying an applied voltage $V_1$ inside the proportional region Wip to the air-fuel ratio sensor 40 or 41, the output current I at the time when the air-fuel ratio sensor 40 or 41 is abnormal rises from the output current I at the time when it is normal by exactly a constant value. Note that, the limit current region Wlc indicates the limit current region which is formed in the state where atmospheric gas circulates around the air-fuel ratio sensor 40 or 41 when the air-fuel ratio sensor 40 or 41 is not abnormal in any way. Similarly, the proportional region Wip indicates a proportional region which is formed in the state where atmospheric gas circulates around the air-fuel ratio sensor 40 or 41 when the air-fuel ratio sensor 40 or 41 is not abnormal in any way.

Therefore, if a circuit etc. of the air-fuel ratio sensor 40 or 41 becomes abnormal, the output current I rises compared with the normal case both if a voltage V applied to the air-fuel ratio sensor 40 or 41 is a voltage inside the limit current region Wlc or is a voltage inside the proportional region Wip. Note that, in the illustrated example, the example is shown where the output current I rises due to an abnormality in a circuit etc. of the air-fuel ratio sensor 40 or 41, but sometimes abnormality of a circuit etc. of the air-fuel ratio sensor 40 or 41 causes the output current I to fall over the entire region.

If in this way a circuit etc. of an air-fuel ratio sensor 40 or 41 becomes abnormal, the output current I of the air-fuel ratio sensor 40 or 41 always becomes a value deviated from the inherent value by a constant value. As a result, if a circuit etc. of the air-fuel ratio sensor 40 or 41 becomes abnormal, in the relationship between the exhaust air-fuel ratio around the air-fuel ratio sensor 40 or 41 and the output current I, as shown in FIG. 6 by X, the output current I deviates from a suitable value to a smaller value in the entire region of the exhaust air-fuel ratio, that is, offset type deviation occurs.

Figure 8:
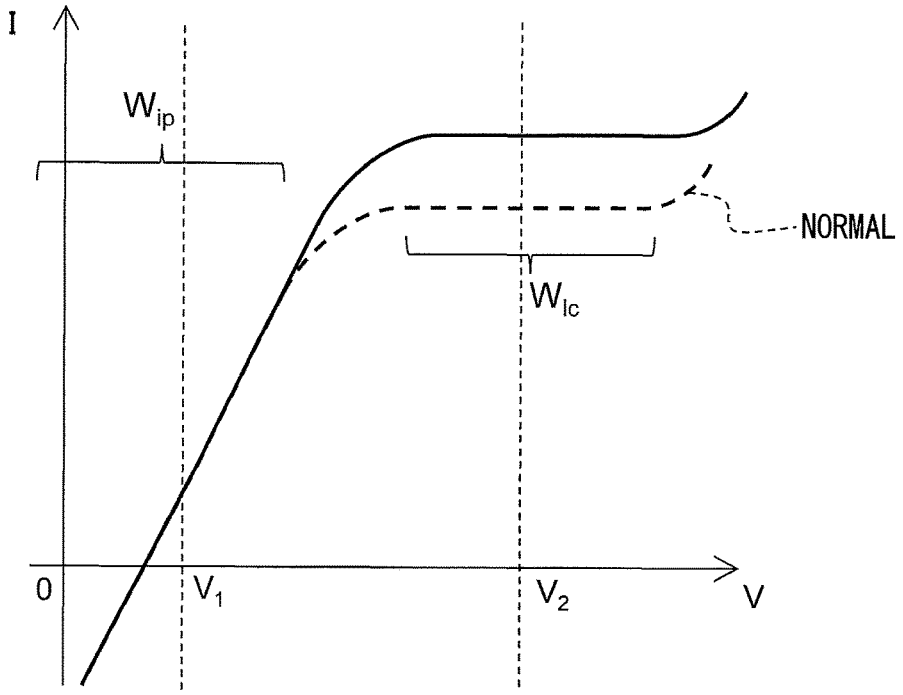
FIG. 8 is a view showing a relationship between a voltage applied to an air-fuel ratio sensor and an output current.

FIG. 8 also shows the relationship between the voltage V applied to the air-fuel ratio sensor 40 or 41 and the output current I in the state where atmospheric gas is circulating around the air-fuel ratio sensor 40 or 41. The solid line in the figure shows the relationship in the case where the diffusion regulation layer 54 of the air-fuel ratio sensor 40 or 41 becomes partially clogged or cracked or otherwise abnormal, or the case where an electrode 52 or 53 of the air-fuel ratio sensor 40 or 41 deteriorates or otherwise becomes abnormal. On the other hand, the broken line in the figure shows the relationship in the case where the air-fuel ratio sensor 40 or 41 does not become abnormal.

As shown in FIG. 8, if the diffusion regulation layer 54 or electrode 52 or 53 etc. of an air-fuel ratio sensor 40 or 41 becomes abnormal, compared with the normal case, the output current I rises by exactly a constant value only in the limit current region Wlc. As a result, when applying an applied voltage $V_2$ inside the limit current region Wlc to the air-fuel ratio sensor 40 or 41, the output current I at the time when the air-fuel ratio sensor 40 or 41 becomes abnormal rises from the output current I at the time when it is normal by exactly a constant value. On the other hand, when applying an applied voltage $V_1$ inside the proportional region Wip to the air-fuel ratio sensor 40 or 41, the output current I at the time when the air-fuel ratio sensor 40 or 41 becomes abnormal and the output current I at the time when it is normal become substantially the same value. Note that, in the illustrated example, the case is shown where abnormality of the diffusion regulation layer 54 or electrode 52 or 53 etc. of the air-fuel ratio sensor 40 or 41 causes the output current I to rise, but sometimes abnormality of the diffusion regulation layer 54 or electrode 52 or 53 etc. of the air-fuel ratio sensor 40 or 41 also causes the output current I to fall.

The reason why such a phenomenon occurs will be explained with reference to the example of the case of the diffusion regulation layer 54 clogging or cracking etc. Here, the above-mentioned such limit current is generated due to the diffusion regulation layer 54. That is, the amount of oxygen ions which can move through the solid electrolyte layer 51 in a unit time is determined in accordance with the applied voltage V. However, in the proportional region, the amount of flow of unburned gas or oxygen passing through the diffusion regulation layer 54 and reaching the electrode 52 is greater than the amount of oxygen ions able to move in this unit time (see FIG. 2). As a result, inside the proportional region, along with the rise of applied voltage V, the amount of oxygen ions moving through the solid electrolyte layer 51 increases and the output current I rises. For this reason, the slope at the V-I graph at this time is determined in accordance with the DC element resistance of the solid electrolyte layer 51.

In this regard, in the limit current region, the amount of unburned gas or oxygen passing through the diffusion regulation layer 54 and reaching the electrode 52 is smaller than the amount of oxygen ions able to pass through the solid electrolyte layer 51 per unit time. As a result, in the limit current region, even if the applied voltage V changes, the amount of oxygen ions moving through the solid electrolyte layer 51 remains constant as the amount of flow of unburned gas or oxygen passing through the diffusion regulation layer 54 and reaching the electrode 52. As a result, in the limit current region, even if the applied voltage V changes, the amount of oxygen ions moving through the inside of the solid electrolyte layer 51 does not change and therefore the output current I also does not change.

If such a diffusion regulation layer 54 clogs or cracks etc. the amount of flow of the unburned gas or oxygen reaching an electrode through the diffusion regulation layer 54 changes. As a result, in the limit current region, the output current I is determined by the amount of flow of the unburned gas or oxygen passing through the diffusion regulation layer 54 and reaching the electrode 52, and therefore the output current I changes. On the other hand, as explained above, inside the proportional region, the amount of oxygen ions which can move through the inside of the solid electrolyte layer 51 per unit time is greater than the amount of flow of the unburned gas or oxygen passing through the diffusion regulation layer 54 and reaching the electrode 52. As a result, even if the diffusion regulation layer 54 is clogged or cracked etc. the output current I inside the proportional region does not change.

Further, if the diffusion regulation layer 54 is clogged or cracked etc. compared with when this does not arise, the extent by which the output current I changes becomes greater the larger the difference of the exhaust air-fuel ratio from the stoichiometric air-fuel ratio. This is because the larger the difference of the exhaust air-fuel ratio from the stoichiometric air-fuel ratio, the greater the amount of oxygen or unburned gas included in the unit exhaust gas, therefore the more the amount of unburned gas or oxygen reaching the electrode 52 changes if the amount of exhaust gas passing through the diffusion regulation layer 54 changes. As a result, if the diffusion regulation layer 54 or electrode 52 or 53 etc. of an air-fuel ratio sensor 40 or 41 becomes abnormal, a slope type deviation such as shown in FIG. 6 by Y occurs.

Figure 9:
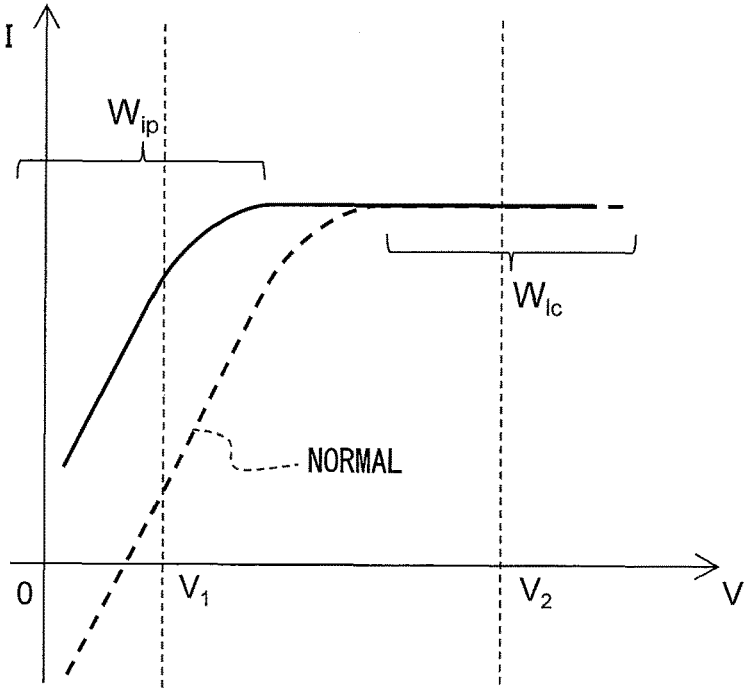
FIG. 9 is a view showing a relationship between a voltage applied to an air-fuel ratio sensor and an output current.
Figure 10:
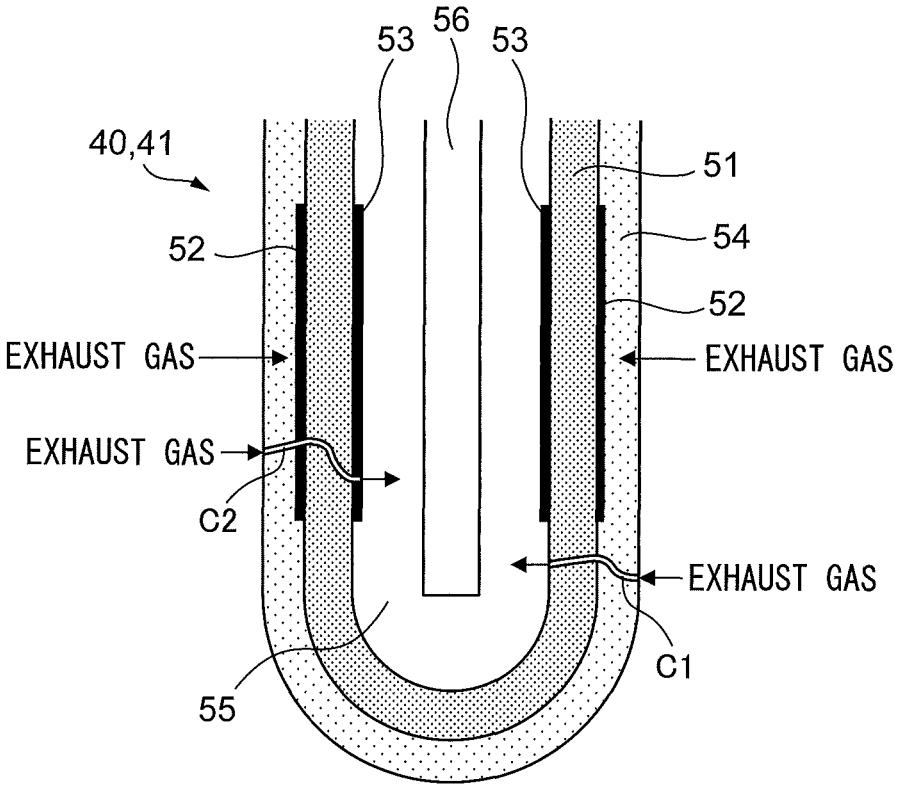
FIG. 10 is a schematic cross-sectional view of an air-fuel ratio sensor having a cracked element.

FIG. 9 shows the relationship between the voltage V applied to an air-fuel ratio sensor 40 or 41 and the output current I in the state where atmospheric gas is circulating around the air-fuel ratio sensor 40 or 41. In the figure, the solid line shows the relationship in the case where the air-fuel ratio sensor 40 or 41 has a cracked element or is otherwise abnormal. Here, a "cracked element" of the air-fuel ratio sensor 40 or 41 specifically means a crack passing through the solid electrolyte layer 51 and diffusion regulation layer 54 (FIG. 10, C1) or a crack passing through not only the solid electrolyte layer 51 and diffusion regulation layer 54, but also the two electrodes 52 and 53 (FIG. 10, C2). On the other hand, in the figure, the broken line shows the relationship in the case where the air-fuel ratio sensor 40 or 41 is not abnormal. If the air-fuel ratio sensor 40 or 41 has a cracked element, the reference gas in the reference gas chamber 55 (usually, atmospheric gas) becomes abnormal (abnormality of reference gas).

As shown in FIG. 9, if an air-fuel ratio sensor 40 or 41 has an abnormality of the reference gas, compared with the normal case, the output current I rises by exactly a constant value only inside the proportional region Wip. As a result, when applying the applied voltage $V_2$ in the limit current region Wlc to the air-fuel ratio sensor 40 or 41, both the output current I when the air-fuel ratio sensor 40 or 41 is abnormal and the output current I at the time when it is normal become substantially the same values. On the other hand, when applying the applied voltage $V_1$ inside the proportional region Wip to the air-fuel ratio sensor 40 or 41, the output current I at the time when the air-fuel ratio sensor 40 or 41 is abnormal rises from the output current I at the time when it is normal by exactly a constant value.

The above phenomena shown from FIG. 7 to FIG. 9 can be summarized as in the following Table 1.

TABLE 1

| | Rise in output current inside proportional region | No change in output current inside proportional region | Fall in output current inside proportional region |
|---|---|---|---|
| Rise in output current inside limit current region | Offset type deviation | Slope type deviation | — |
| No change in output current inside limit current region | Abnormality of reference gas | Normal | Abnormality of reference gas |
| Fall in output current inside limit current region | — | Slope type deviation | Offset type deviation |

<Control of Abnormality Diagnosis>

Therefore, in the present embodiment, there is provided an abnormality diagnosis system of an air-fuel ratio sensor provided in an exhaust passage of an internal combustion engine and generating a limit current corresponding to an air-fuel ratio, wherein the system comprises a current detecting part 61 detecting an output current I of an air-fuel ratio sensor 40 or 41 and an applied voltage control device 60 controlling a voltage applied to the air-fuel ratio sensor 40 or 41, the system applies a voltage inside a limit current region where a limit current is generated and a voltage outside the limit current region (in particular, a proportional region) to the air-fuel ratio sensor 40 or 41 when the air-fuel ratio of the exhaust gas circulating around the air-fuel ratio sensor 40 or 41 is made a predetermined constant air-fuel ratio, and judges a type of abnormality occurring at the air-fuel ratio sensor 40 or 41 based on an output current I of the air-fuel ratio sensor 40 or 41 detected by the current detecting part at this time. The voltage inside the limit current region and the voltage outside the limit current region are applied, for example, by changing the voltage applied to the air-fuel ratio sensor 40 or 41 by the applied voltage control device 60 in the state maintaining the air-fuel ratio of the exhaust gas circulating around the air-fuel ratio sensor 40 or 41 at a constant air-fuel ratio.

In particular, in the present embodiment, when an air-fuel ratio sensor 40 or 41 is normal, the output currents when applying a voltage inside the limit current region and when applying a voltage outside the limit current region to the air-fuel ratio sensor 40 or 41 in the state where the air-fuel ratio of the exhaust gas circulating around the air-fuel ratio sensor 40 or 41 is maintained at a predetermined constant air-fuel ratio are respectively detected or calculated in advance as a normal value inside the limit current region and a normal value outside the limit current region, and the type of abnormality occurring at the air-fuel ratio sensor 40 or 41 is judged based on the difference between the detected value of the output current of the air-fuel ratio sensor 40 or 41 when applying a voltage inside the limit current region to the air-fuel ratio sensor 40 or 41 in the state where the air-fuel ratio of the exhaust gas circulating around the air-fuel ratio sensor 40 or 41 is maintained at the predetermined constant air-fuel ratio and the normal value inside the limit current region, and the difference between the detected value of the output current of the air-fuel ratio sensor 40 or 41 when applying the voltage outside the limit current region to the air-fuel ratio sensor 40 or 41 and the normal value outside the limit current region.

<Explanation of Control Using Time Chart>

Next, referring to the time chart shown in FIG. 11, the diagnosis of abnormality of an air-fuel ratio sensor in the present embodiment will be explained using as an example the case of diagnosing abnormality of the downstream side air-fuel ratio sensor 41. In the present embodiment, as already explained referring to FIG. 5, usually the target air-fuel ratio is alternately changed between a rich set air-fuel ratio AFTrich and a lean set air-fuel ratio AFTlean. Such control alternately changing the target air-fuel ratio between the rich set air-fuel ratio AFTrich and the lean set air-fuel ratio AFTlean will be called "normal control".

On the other hand, in the present embodiment, at the time of deceleration of the vehicle mounting the internal combustion engine etc. even in the state where the crankshaft or piston 3 is operating (that is, during operation of the internal combustion engine), the feed of fuel from a fuel injector 11 to a combustion chamber 5 is stopped as fuel cut control. Further, if fuel cut control is performed, the oxygen storage amount of the exhaust purification catalyst 20 or 24 reaches the maximum storable amount of oxygen. For this reason, to release the oxygen stored in the exhaust purification catalyst 20 or 24 after the end of fuel cut control, the target air-fuel ratio is made richer than the rich set air-fuel ratio AFTrich at the time of the above-mentioned normal control as post-reset rich control.

Here, the downstream side air-fuel ratio sensor 41 is diagnosed for abnormality in the present embodiment when the air-fuel ratio of the exhaust gas around the downstream side air-fuel ratio sensor 41 is maintained at a constant air-fuel ratio. In particular, in the present embodiment, abnormality is diagnosed during fuel cut control where the air-fuel ratio of the exhaust gas around the downstream side air-fuel ratio sensor 41 is maintained at an air-fuel ratio corresponding to the atmospheric gas. In addition, in the present embodiment, abnormality is diagnosed also during post-reset rich control where the air-fuel ratio of the exhaust gas around the downstream side air-fuel ratio sensor 41 becomes substantially the stoichiometric air-fuel ratio.

Figure 11:
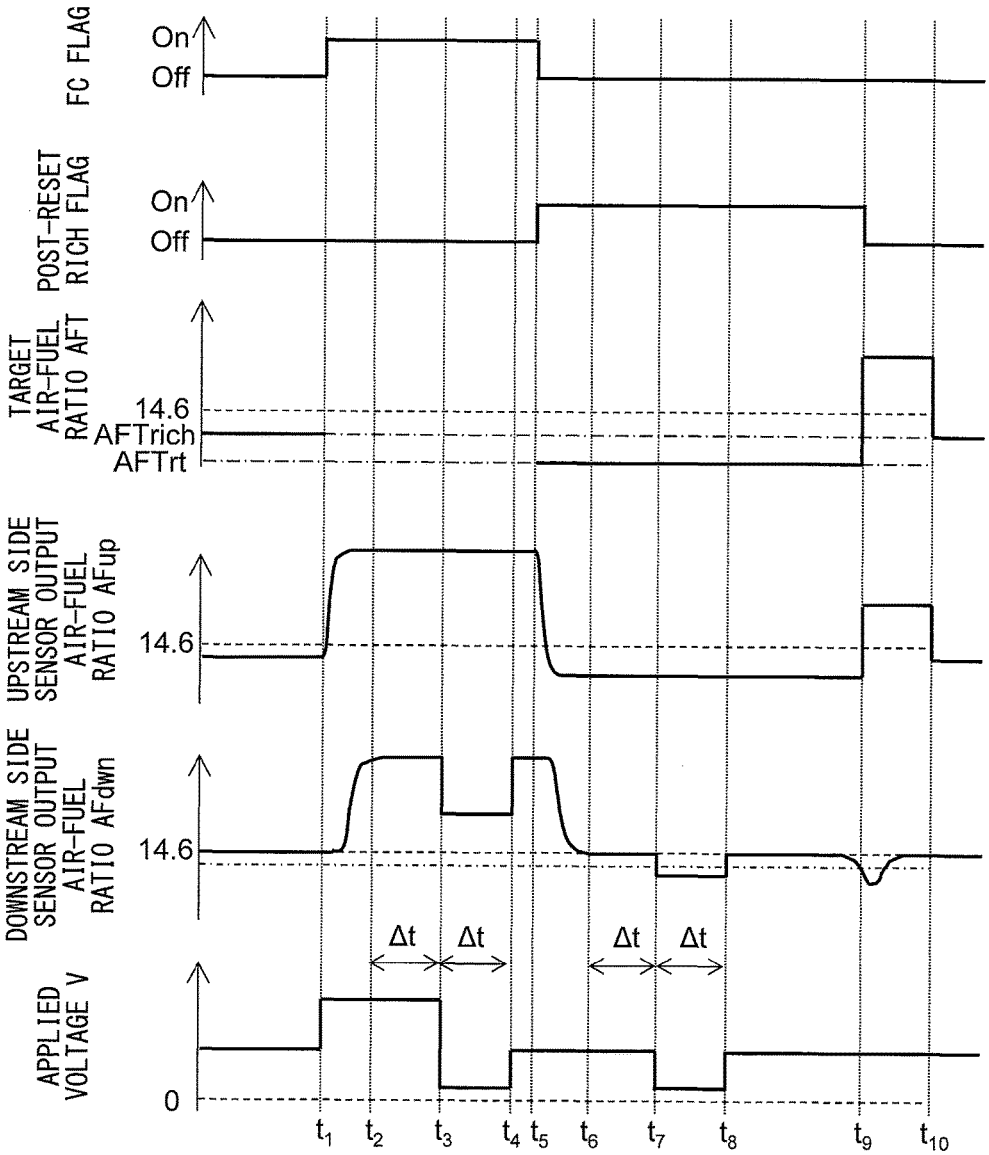
FIG. 11 is a time chart showing a change of an output air-fuel ratio of a downstream side air-fuel ratio sensor etc. when diagnosing abnormality.

FIG. 11 is a time chart of the presence of these fuel cut control and post-reset rich control, the target air-fuel ratio, the output air-fuel ratio of the upstream side air-fuel ratio sensor 40, the output air-fuel ratio of the downstream side air-fuel ratio sensor 41, and the voltage applied to the downstream side air-fuel ratio sensor 41.

In the example shown in FIG. 11, at the time $t_1$, fuel cut control is started. The case is shown where before fuel cut control is started at the time $t_1$, the target air-fuel ratio is the rich set air-fuel ratio AFTrich at the time of normal control alternately changing the target air-fuel ratio between the rich air-fuel ratio and the lean air-fuel ratio. At this time, the output air-fuel ratio of the upstream side air-fuel ratio sensor 40 becomes a rich air-fuel ratio. Further, at this time, the unburned gas in the exhaust gas flowing into the upstream side exhaust purification catalyst 20 is removed by the upstream side exhaust purification catalyst 20, therefore the output air-fuel ratio of the downstream side air-fuel ratio sensor 41 becomes the stoichiometric air-fuel ratio.

If at the time $t_1$ the fuel cut control is started, atmospheric gas flows out from the engine body 1, therefore the output air-fuel ratio AFup of the upstream side air-fuel ratio sensor 40 changes to a lean air-fuel ratio with an extremely large lean degree corresponding to atmospheric gas. Further, atmospheric gas also flows into the upstream side exhaust purification catalyst 20, but the oxygen in the atmospheric gas flowing into the upstream side exhaust purification catalyst 20 is stored in the upstream side exhaust purification catalyst 20. For this reason, right after the start of the fuel cut control, the output air-fuel ratio of the downstream side air-fuel ratio sensor 41 is maintained at substantially the stoichiometric air-fuel ratio. However, the oxygen storage amount of the upstream side exhaust purification catalyst 20 immediately reaches the maximum storable amount of oxygen, and atmospheric gas flows out from the upstream side exhaust purification catalyst 20. As a result, the output air-fuel ratio of the downstream side air-fuel ratio sensor 41 also changes to a lean air-fuel ratio with an extremely large lean degree corresponding to the atmospheric gas.

Further, in the present embodiment, at the time $t_1$ when fuel cut control is started, to start the diagnosis of abnormality of the downstream side air-fuel ratio sensor 41, the voltage V applied to the downstream side air-fuel ratio sensor 41 is made to rise to a second voltage $V_2$ (for example, 1.0V). Here, the second voltage $V_2$ is the voltage in the limit current region Wlc formed in the state where atmospheric gas circulates around the downstream side air-fuel ratio sensor 41 in the case where the downstream side air-fuel ratio sensor 41 is not abnormal.

After that, in the example shown in FIG. 11, at the time $t_2$, the output air-fuel ratio of the downstream side air-fuel ratio sensor 41 stops rising and converges to a constant value. In the present embodiment, the diagnosis of abnormality is started at the time $t_2$ when the output air-fuel ratio of the downstream side air-fuel ratio sensor 41 settles down, and the voltage applied to the downstream side air-fuel ratio sensor 41 is maintained constant over a predetermined constant time $\Delta t$ from the time $t_2$.

After that, in the present embodiment, at the time $t_3$ after a predetermined constant time $\Delta t$ elapses from the time $t_2$, the voltage V applied to the downstream side air-fuel ratio sensor 41 is lowered to a first voltage $V_1$ (for example, 0.2V). Here, the first voltage $V_1$ is the voltage inside the proportional region Wip formed in the state where atmospheric gas circulates around the downstream side air-fuel ratio sensor 41 when the downstream side air-fuel ratio sensor 41 is not abnormal. In the present embodiment, the voltage applied to the downstream side air-fuel ratio sensor 41 is maintained constant over a predetermined constant time Δt from the time $t_3$ when the voltage V applied to the downstream side air-fuel ratio sensor 41 is changed to the first voltage $V_1$.

In the example shown in FIG. 11, at the time $t_4$ after a predetermined constant time Δt elapses from when the voltage V applied to the downstream side air-fuel ratio sensor 41 is changed to the first voltage $V_1$, the output current I of the downstream side air-fuel ratio sensor 41 for diagnosis of abnormality finishes being detected. Therefore, at the time $t_4$, the voltage applied to the downstream side air-fuel ratio sensor 41 is made to rise to the voltage for normal control (for example, 0.45V). In the example shown in FIG. 11, after this, the fuel cut control is made to end at the time $t_5$.

If at the time $t_5$ the fuel cut control is made to end, post-reset rich control is started along with this. For this reason, the target air-fuel ratio is made a post-reset rich set air-fuel ratio AFTrt richer than the rich set air-fuel ratio AFTrich. If the target air-fuel ratio becomes the post-reset rich set air-fuel ratio, along with this, the output air-fuel ratio of the upstream side air-fuel ratio sensor 40 also changes to an air-fuel ratio corresponding to the post-reset rich set air-fuel ratio AFTrt. Further, exhaust gas of a rich air-fuel ratio flows into the upstream side exhaust purification catalyst 20 as well, but the unburned gas in the exhaust gas flowing into the upstream side exhaust purification catalyst 20 reacts with the oxygen stored in the upstream side exhaust purification catalyst 20 to be removed. As a result, the output air-fuel ratio of the downstream side air-fuel ratio sensor 41 is decreased if post-reset rich control is started at the time $t_5$ and finally becomes substantially the stoichiometric air-fuel ratio.

Further, in the present embodiment, at the time $t_5$ when the post-reset rich control is started, to start the diagnosis of abnormality of the downstream side air-fuel ratio sensor 41, the voltage V applied to the downstream side air-fuel ratio sensor 41 is made a fourth voltage $V_4$ (for example, 0.45V). Here, the fourth voltage $V_4$ is the voltage inside the limit current region formed in the state where exhaust gas of the stoichiometric air-fuel ratio circulates around the downstream side air-fuel ratio sensor 41 when the downstream side air-fuel ratio sensor 41 is not abnormal.

After that, in the example shown in FIG. 11, at the time $t_6$, the output air-fuel ratio of the downstream side air-fuel ratio sensor 41 finishes falling and converges to a constant value. In the present embodiment, the voltage applied to the downstream side air-fuel ratio sensor 41 is maintained constant over a predetermined constant time Δt from the time $t_6$ at which the output air-fuel ratio of the downstream side air-fuel ratio sensor 41 settles down.

After that, in the present embodiment, the voltage V applied to the downstream side air-fuel ratio sensor 41 is made to fall to a third applied voltage $V_3$ (for example, 0.1V) at the time $t_7$ after a predetermined constant time Δt elapses from the time $t_6$. Here, the third voltage $V_3$ is a voltage inside the proportional region formed in the state where exhaust gas of the stoichiometric air-fuel ratio circulates around the downstream side air-fuel ratio sensor 41 when the downstream side air-fuel ratio sensor 41 is not abnormal. In the present embodiment, the voltage applied to the downstream side air-fuel ratio sensor 41 is maintained constant over a predetermined constant time Δt from the time $t_7$ at which the voltage V applied to the downstream side air-fuel ratio sensor 41 is changed to the third voltage $V_3$.

In the example shown in FIG. 11, at the time $t_8$ after the elapse of a predetermined constant time Δt from the time $t_7$, the diagnosis of abnormality is ended. Therefore, at the time $t_8$, the voltage applied to the downstream side air-fuel ratio sensor 41 is made to rise to the normal control voltage (for example, 0.45V). Further, in the example shown in FIG. 11, even at the time $t_8$, the post-reset rich control has not ended, therefore the target air-fuel ratio is maintained at the post-reset rich set air-fuel ratio AFTrt. Due to this, the output air-fuel ratio of the upstream side air-fuel ratio sensor 40 is made the rich air-fuel ratio, and the oxygen storage amount of the upstream side exhaust purification catalyst 20 is gradually decreased.

After that, the oxygen storage amount of the upstream side exhaust purification catalyst 20 is gradually decreased and finally becomes substantially zero, and exhaust gas of a rich air-fuel ratio starts to flow out from the upstream side exhaust purification catalyst 20. Due to this, at the time $t_9$, the output air-fuel ratio of the downstream side air-fuel ratio sensor 41 becomes the rich judged air-fuel ratio AFrich or less. In the present embodiment, in this way, if the output air-fuel ratio of the downstream side air-fuel ratio sensor 41 becomes the rich judged air-fuel ratio AFrich or less, post-reset rich control is made to end and the normal control shown in FIG. 5 is resumed.

Here, in the present embodiment, when the downstream side air-fuel ratio sensor 41 is normal, the output current at the time when the voltage V applied to the downstream side air-fuel ratio sensor 41 in the state where the exhaust air-fuel ratio around the downstream side air-fuel ratio sensor 41 is an air-fuel ratio corresponding to atmospheric gas is a voltage $V_2$ inside the limit current region Wlc is detected or calculated in advance experimentally or by computation as a normal value. Similarly, when the downstream side air-fuel ratio sensor 41 is normal, the output current when the voltage V applied to the downstream side air-fuel ratio sensor 41 in the state where the exhaust air-fuel ratio around the downstream side air-fuel ratio sensor 41 is an air-fuel ratio corresponding to atmospheric gas is a voltage $V_1$ inside the proportional region Wip is detected or calculated in advance experimentally or by computation as a normal value.

Further, when performing control such as shown in FIG. 11, if the downstream side air-fuel ratio sensor 41 is normal, as explained above, the detected value of the output current I by the current detecting part 61 in the state applying a voltage $V_2$ inside a limit current region to the downstream side air-fuel ratio sensor 41 substantially matches the normal value in such a state (normal value inside the limit current region). Similarly, when the downstream side air-fuel ratio sensor 41 is normal, as explained above, the detected value of the output current I by the current detecting part 61 in the state applying a voltage $V_1$ inside the proportional region to the downstream side air-fuel ratio sensor 41 substantially matches the normal value in such a state (normal value outside the limit current region). Therefore, in the present embodiment, when the detected value of the output current I of the downstream side air-fuel ratio sensor 41 at the times $t_2$ to $t_3$ substantially matches the corresponding normal value inside a limit current region and the detected value of the output current I of the downstream side air-fuel ratio sensor 41 at the times $t_3$ to $t_4$ substantially matches the corresponding normal value outside the limit current region, it is judged the downstream side air-fuel ratio sensor 41 is normal.

On the other hand, if the circuit etc. of the downstream side air-fuel ratio sensor 41 is abnormal, that is, if the downstream side air-fuel ratio sensor 41 suffers from offset type deviation, as explained above, the detected value of the output current I by the current detecting part 61 in the state applying a voltage $V_2$ inside the limit current region to the downstream side air-fuel ratio sensor 41 becomes a value whereby the difference from the corresponding normal value inside the limit current region becomes a predetermined reference value (reference value inside the limit current region) or more. Similarly, when the downstream side air-fuel ratio sensor 41 suffers from offset type deviation, as explained above, the detected value of the output current I by the current detecting part 61 in the state applying a voltage $V_1$ inside the proportional region to the downstream side air-fuel ratio sensor 41 becomes a value whereby the difference from the corresponding normal value outside the limit current region becomes a predetermined reference value (reference value outside the limit current region) or more. Therefore, in the present embodiment, when the difference between the detected value of the output current I of the downstream side air-fuel ratio sensor 41 at the times $t_2$ to $t_3$ and the corresponding normal value inside the limit current region is the reference value or more and the difference between the detected value of the output current I of the downstream side air-fuel ratio sensor 41 at the times $t_3$ to $t_4$ and the corresponding normal value outside the limit current region is the reference value or more, it is judged that offset type deviation has occurred at the downstream side air-fuel ratio sensor 41.

On the other hand, if the diffusion regulation layer 54 or electrode 52 etc. of the downstream side air-fuel ratio sensor 41 becomes abnormal, that is, if the downstream side air-fuel ratio sensor 41 suffers from a slope type deviation, as explained above, the detected value of the output current I by the current detecting part 61 in the state applying a voltage $V_2$ inside the limit current region to the downstream side air-fuel ratio sensor 41 becomes a value whereby the difference from the corresponding normal value inside the limit current region becomes a predetermined reference value (reference value inside the limit current region) or more. Similarly, if the downstream side air-fuel ratio sensor 41 suffers from a slope type deviation, as explained above, the detected value of the output current I by the current detecting part 61 in the state applying a voltage $V_1$ inside the proportional region to the downstream side air-fuel ratio sensor 41 substantially matches the corresponding normal value outside the limit current region. Therefore, in the present embodiment, when the difference between the detected value of the output current I of the downstream side air-fuel ratio sensor 41 at the times $t_2$ to $t_3$ and the corresponding normal value inside the limit current region is the reference value or more and the detected value of the output current I of the downstream side air-fuel ratio sensor 41 at the times $t_3$ to $t_4$ substantially matches the corresponding normal value outside the limit current region, it is judged that the downstream side air-fuel ratio sensor 41 suffers from slope type deviation.

Furthermore, when the downstream side air-fuel ratio sensor 41 has a cracked element or is otherwise abnormal, that is, when the downstream side air-fuel ratio sensor 41 has an abnormality of the reference gas, as explained above, the detected value of the output current I by the current detecting part 61 in the state applying a voltage $V_2$ inside the limit current region to the downstream side air-fuel ratio sensor 41 substantially matches the corresponding normal value inside the limit current region. Similarly, if the downstream side air-fuel ratio sensor 41 suffers from a slope type deviation, as explained above, the detected value of the output current I by the current detecting part 61 in the state applying a voltage $V_1$ inside the proportional region to the downstream side air-fuel ratio sensor 41 becomes a value whereby the difference from the corresponding normal value outside the limit current region becomes a predetermined reference value (reference value outside the limit current region) or more. Therefore, in the present embodiment, when the detected value of the output current I of the downstream side air-fuel ratio sensor 41 at the times $t_2$ to $t_3$ substantially matches the corresponding normal value inside the limit current region and the difference between the detected value of the output current I of the downstream side air-fuel ratio sensor 41 at the times $t_3$ to $t_4$ and the corresponding normal value outside the limit current region is the reference value or more, it is judged that the downstream side air-fuel ratio sensor 41 suffers from an abnormality of the reference gas.

Further, similarly, detection is also possible based on the output current I of the downstream side air-fuel ratio sensor 41 detected at the times $t_6$ to $t_7$ and the output current I of the downstream side air-fuel ratio sensor 41 detected at the times $t_7$ to $t_8$. In this case as well, when the downstream side air-fuel ratio sensor 41 is normal, in the state where the exhaust air-fuel ratio around the downstream side air-fuel ratio sensor 41 is the stoichiometric air-fuel ratio, the output current when the voltage V applied to the downstream side air-fuel ratio sensor 41 is a voltage $V_4$ in the limit current region is detected or calculated in advance experimentally or by computation as a normal value inside the limit current region. Similarly, when the downstream side air-fuel ratio sensor 41 is normal, in the state where the exhaust air-fuel ratio around the downstream side air-fuel ratio sensor 41 is the stoichiometric air-fuel ratio, the output current when the voltage V applied to the downstream side air-fuel ratio sensor 41 is a voltage $V_3$ inside the proportional region Wip is detected or calculated in advance experimentally or by computation as a normal value outside the limit current region.

Further, when performing control such as shown in FIG. 11, the difference between the detected value of the output current I by the current detecting part 61 in the state applying a voltage $V_4$ inside the limit current region to the downstream side air-fuel ratio sensor 41 and the corresponding normal value inside the limit current region is calculated. In addition, the difference of the detected value of the output current I by the current detecting part 61 in the state applying a voltage $V_3$ inside the proportional region to the downstream side air-fuel ratio sensor 41 and the corresponding normal value outside the limit current region is calculated. Based on the difference of the output current I calculated in this way, the same technique as in the case of the above-mentioned times $t_2$ to $t_4$ is used to diagnose the mode of abnormality of the downstream side air-fuel ratio sensor 41.

Note that, in the above embodiment, at the times $t_2$ to $t_4$ during fuel cut control and the times $t_6$ to $t_8$ during post-reset rich control, diagnosis of abnormality is performed two times. However, the downstream side air-fuel ratio sensor 41 may be diagnosed for abnormality at just one of these.

Further, in the above embodiment, the diagnosis of abnormality of the downstream side air-fuel ratio sensor 41 was used as an example for the explanation, but the upstream side air-fuel ratio sensor 40 can also be similarly diagnosed for abnormality. However, during post-reset rich control, exhaust gas before flowing into the upstream side exhaust purification catalyst 20 circulates around the upstream side air-fuel ratio sensor 40. Therefore, during post-reset rich control, what kind of air-fuel ratio the air-fuel ratio of the exhaust gas circulating around the upstream side air-fuel ratio sensor 40 becomes is unknown. For this reason, the upstream side air-fuel ratio sensor 40 is not diagnosed for abnormality during post-reset rich control.

Furthermore, the above embodiment applies one voltage inside the limit current region and one voltage inside the proportional region to the downstream side air-fuel ratio sensor 41 and judges the type of abnormality of an air-fuel ratio sensor 40 or 41 based on the output current I of the air-fuel ratio sensor 40 or 41 at this time. However, it is also possible to apply pluralities of different voltages inside the limit current region and inside the proportional region, and possible to apply a plurality of different voltages at the inside of only one of the limit current region and proportional region. Here, inside the limit current region, basically, even if the applied voltage V changes, the output current I does not change, but inside the proportional region, if the applied voltage V changes, the output current I also changes. For this reason, the number of times of application of different voltage inside the proportional region is preferably greater than the number of times of application of different voltage in the limit current region.

According to the present embodiment, as explained above, by detecting the output current of an air-fuel ratio sensor in the state applying a voltage inside the limit current region and a voltage inside the proportional region to the air-fuel ratio sensor 40 or 41, it is possible to differentiate the different modes of abnormality in particular as abnormalities due to offset type deviation and abnormalities due to other causes.

<Flow Chart>

Figure 12:
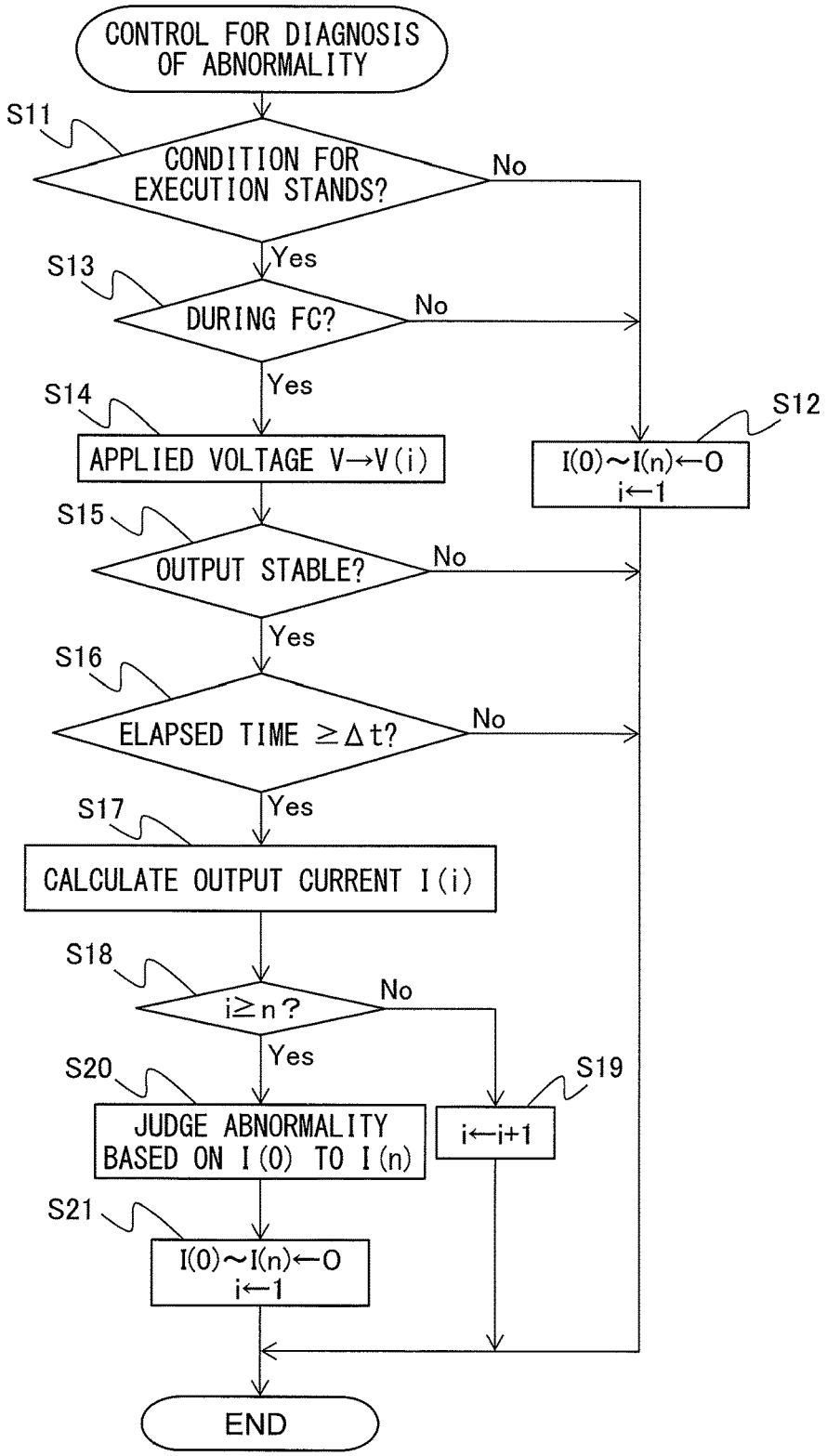
FIG. 12 is a flow chart for diagnosis of abnormality of a downstream side air-fuel ratio sensor.

FIG. 12 shows a flow chart of the control routine for diagnosis of abnormality of the downstream side air-fuel ratio sensor 41. In particular, FIG. 12 shows a flow chart in the case of diagnosing abnormality during fuel cut control, that is, in the case of diagnosing abnormality at the times $t_2$ to $t_4$ of FIG. 11. Note that, the illustrated control routine is performed by interruption at every constant time interval.

First, at step S11, it is judged if the condition for diagnosis of abnormality stands. The case where the condition for diagnosis of abnormality stands is, for example, when the temperature of the downstream side air-fuel ratio sensor 41 becomes the active temperature or more and the diagnosis of the downstream side air-fuel ratio sensor 41 for abnormality has not yet finished after the internal combustion engine has been started up or the ignition key of the vehicle mounting the internal combustion engine has been turned on. If at step S11 it is judged that the condition for diagnosis of abnormality does not stand, the routine proceeds to step S12. At step S12, the later explained number of times "i" of application of different voltage is reset to 1, the output currents I(1) to I(n) at the time of the first to n-th applications of voltage are reset to 0, and the control routine is made to end.

On the other hand, if at step S11 it is judged that the condition for diagnosis of abnormality stands, the routine proceeds to step S13. At step S13, it is judged if fuel cut control (FC) is underway. If at step S13 it is judged fuel cut control is not underway, the routine proceeds to step S12 where the number of times "i" of application of voltage is reset to 1, the output currents at the time of the first to n-th applications of voltage are reset to 0, and the control routine is made to end.

After that, if fuel cut control is started, at the next control routine, the routine proceeds from step S13 to step S14. At step S14, the voltage V applied to the downstream side air-fuel ratio sensor 41 is made the i-th applied voltage V(i). Here, the i-th applied voltage V(i) is set in advance. For example, the first applied voltage V(1) is made a voltage inside the limit current region occurring in a state where atmospheric gas circulates around an air-fuel ratio sensor 40 or 41 in the case where no abnormality occurs in the air-fuel ratio sensor 40 or 41. In addition, the second applied voltage V(2) is made a voltage inside the proportional region formed in the state where atmospheric gas circulates around the air-fuel ratio sensor 40 or 41 in the case where no abnormality occurs at the air-fuel ratio sensor 40 or 41. Note that, the number of times "i" of application of different voltage and the i-th applied voltage V(i) may be set to any number and voltage if applying a voltage inside the limit current region at least one time and applying a voltage inside the proportional region at least one time.

Here, before starting fuel cut control, the number of times "i" of application of the voltage is set to 1 by step S12. Therefore, right after the start of fuel cut control, at step S14, the number of times "i" of application of the voltage is set to 1. For this reason, right after the start of fuel cut control, the applied voltage V is made the first applied voltage V(1), for example, is made a voltage $V_2$ inside the limit current region. Next, at step S15, it is judged if the output current I of the downstream side air-fuel ratio sensor 41 has stabilized. Whether the output current I of the downstream side air-fuel ratio sensor 41 has stabilized is judged based on, for example, whether the amount of change of the output current I of the downstream side air-fuel ratio sensor 41 per unit time has become a constant amount or less. Alternatively, whether the output current I of the downstream side air-fuel ratio sensor 41 has stabilized may be judged based on whether the time elapsed from changing the applied voltage V is a predetermined time or more.

When at step S15 it is judged that the output current I of the downstream side air-fuel ratio sensor 41 has not stabilized, the control routine is made to end. On the other hand, if the output current I of the downstream side air-fuel ratio sensor 41 stabilizes, the routine proceeds from step S15 to step S16. At step S16, it is judged that the elapsed time from when it is judged at step S15 that the output current I of the downstream side air-fuel ratio sensor 41 has stabilized is a predetermined constant time Δt or more. When at step S16 it is judged that the elapsed time is shorter than the constant time Δt, the control routine is made to end.

On the other hand, if time has elapsed from when it is judged that the output current I of the downstream side air-fuel ratio sensor 41 has stabilized and the constant time Δt or more has elapsed, at the next control routine, the routine proceeds from step S16 to step S17. At step S17, the average value of the output current I of the downstream side air-fuel ratio sensor 41 from when it is judged that the output current I of the downstream side air-fuel ratio sensor 41 has stabilized to when the constant time Δt has elapsed is calculated, then this average value is made the output current I(i) when applying the i-th applied voltage V(i). Therefore, when the first applied voltage V(1) is applied, the output current I(1) when applying the first applied voltage V(1) is calculated.

Next, at step S18, it is judged if the number of times "i" of application of different voltage is "n" times or more. "n" is made a value of 2 or more. When the current number of times "i" of application of different voltage is smaller than "n", the routine proceeds to step S19. At step S19, the number of times "i" of application of different voltage is incremented by 1, then the control routine is made to end.

If the number of times "i" of application of different voltage is incremented by 1 and the number of times of application of different voltage becomes 2, at the next control routine, at step S14, the applied voltage V is made the second applied voltage V(2). After that, if it is judged if the elapsed time from when it is judged the output current I of the downstream side air-fuel ratio sensor 41 has stabilized after the applied voltage V is made the second applied voltage V(2) has become the constant time Δt or more, the routine proceeds again to step S17. At step S17, the average value of the output current I of the downstream side air-fuel ratio sensor 41 from when it is judged that the output current I of the downstream side air-fuel ratio sensor 41 has stabilized to when a constant time Δt elapses is calculated and this average value is made the output current I(2) when applying the second applied voltage V(2).

Next, at step S18, it is judged if the number of times "i" of application of different voltage is "n" times or more. When "n" is 2, it is judged that the number of times "i" of application of different voltage has become "n" times or more. On the other hand, when "n" is 3 or more, steps S11 to S17 are repeated until the number of times of application of different voltage becomes "n" times. When at step S18 it is judged that the number of times "i" of application of different voltage is "n" times or more, the routine proceeds to step S20.

At step S20, based on the output currents I(0) to I(n) calculated at step S17, these are compared with the normal value as explained above and the mode of abnormality of the downstream side air-fuel ratio sensor 41 is judged. Next, at step S21, the number of times "i" of application of different voltage is reset to 1, the output currents at the times of the first to n-th applications of voltage are reset to 0, and the control routine is made to end.

Note that, the control routine shown in FIG. 12 shows the case of diagnosing abnormality during fuel cut control, but a similar control routine can be used for diagnosis of abnormality when diagnosing abnormality during post-reset rich control as well. In this case, at step S13, it is judged not if fuel cut control is underway, but if post-reset rich control is underway. Further, in this case, the i-th applied voltage V(i) is also made a voltage different from the applied voltage in the case during fuel cut control.

<Second Embodiment>

Next, referring to FIG. 13 and FIG. 14, an abnormality diagnosis system according to a second embodiment of the present invention will be explained. The configuration and control in the abnormality diagnosis system according to second embodiment are basically the same as the configuration and control in the abnormality diagnosis system according to the first embodiment except for the parts explained below.

In this regard, when the upstream side air-fuel ratio sensor 40 is not abnormal, if the output air-fuel ratio of the upstream side air-fuel ratio sensor 40 is controlled by feedback to become the target air-fuel ratio, the air-fuel ratio of the exhaust gas flowing into the upstream side exhaust purification catalyst 20 becomes an air-fuel ratio the same as the target air-fuel ratio. Therefore, if maintaining the target air-fuel ratio constant at the stoichiometric air-fuel ratio, the air-fuel ratio of the exhaust gas flowing into the upstream side exhaust purification catalyst 20 becomes the stoichiometric air-fuel ratio, and the air-fuel ratio of the exhaust gas circulating around the downstream side air-fuel ratio sensor 41 is also maintained constant at the stoichiometric air-fuel ratio.

Further, if maintaining the target air-fuel ratio constant at the rich air-fuel ratio, the unburned gas in the exhaust gas flowing into the upstream side exhaust purification catalyst 20 is removed by the upstream side exhaust purification catalyst 20. For this reason, when starting to maintain the target air-fuel ratio at the rich air-fuel ratio, the air-fuel ratio of the exhaust gas circulating around the downstream side air-fuel ratio sensor 41 becomes substantially the stoichiometric air-fuel ratio. However, if the oxygen storage amount of the upstream side exhaust purification catalyst 20 becomes zero, the unburned gas will no longer be removed at the upstream side exhaust purification catalyst 20. For this reason, finally, the air-fuel ratio of the exhaust gas circulating around the downstream side air-fuel ratio sensor 41 is maintained constant at the rich air-fuel ratio of the target air-fuel ratio.

If diagnosing the downstream side air-fuel ratio sensor 41 for abnormality, so long as the output air-fuel ratio of the upstream side air-fuel ratio sensor 40 is controlled by feedback to become the target air-fuel ratio, the air-fuel ratio of the exhaust gas circulating around the downstream side air-fuel ratio sensor 41 can be maintained constant at the target air-fuel ratio. Therefore, in the present embodiment, the downstream side air-fuel ratio sensor 41 is diagnosed for abnormality when the air-fuel ratio of the exhaust gas circulating around the downstream side air-fuel ratio sensor 41 is maintained at a predetermined constant air-fuel ratio by maintaining the target air-fuel ratio constant at a predetermined air-fuel ratio.

Next, referring to the time chart shown in FIG. 13, the diagnosis of abnormality of the downstream side air-fuel ratio sensor 41 at the present embodiment will be explained using as an example the case of maintaining the target air-fuel ratio at the stoichiometric air-fuel ratio. FIG. 13 is a time chart of the abnormality diagnosis flag, the target air-fuel ratio, the output air-fuel ratio of the upstream side air-fuel ratio sensor 40, the output air-fuel ratio of the downstream side air-fuel ratio sensor 41, and voltage applied to the downstream side air-fuel ratio sensor 41.

In the present embodiment as well, as already explained referring to FIG. 5, normally the target air-fuel ratio is alternately changed between the rich set air-fuel ratio AFTrich and the lean set air-fuel ratio AFTlean. In the example shown in FIG. 13, the case is shown where, at the time $t_1$, before the target air-fuel ratio is made the stoichiometric air-fuel ratio to start diagnosis of abnormality, the target air-fuel ratio becomes the rich set air-fuel ratio AFTrich at the time of normal control alternately changing the target air-fuel ratio between the rich air-fuel ratio and the lean air-fuel ratio.

Figure 13:
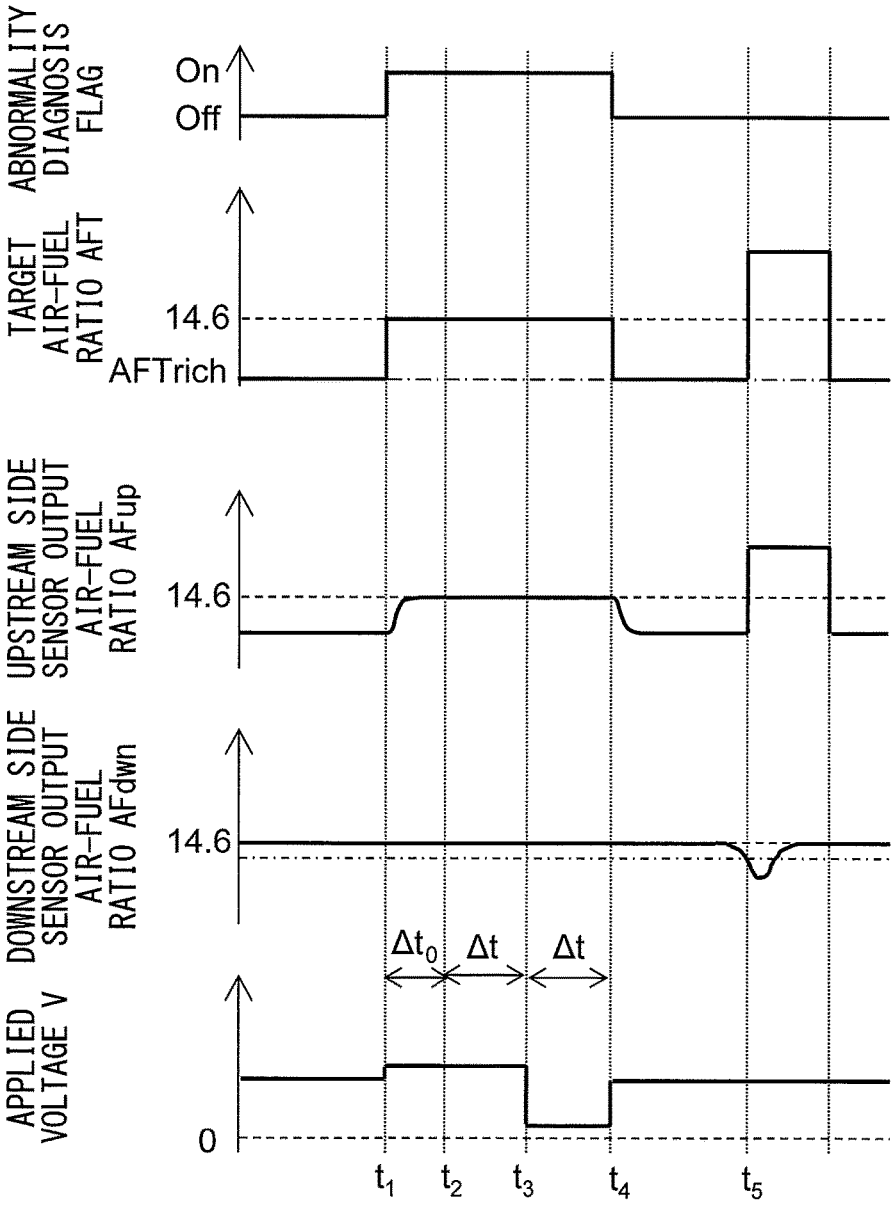
FIG. 13 is a flow chart showing a change of an output air-fuel ratio of a downstream side air-fuel ratio sensor etc. when diagnosing abnormality.

In the example shown in FIG. 13, at the time $t_1$, to start the diagnosis of abnormality, the target air-fuel ratio is changed from the rich set air-fuel ratio AFTrich to the stoichiometric air-fuel ratio (14.6). Along with this, the output air-fuel ratio AFup of the upstream side air-fuel ratio sensor is changed to the stoichiometric air-fuel ratio. On the other hand, the output air-fuel ratio AFdwn of the downstream side air-fuel ratio sensor 41 is maintained at the stoichiometric air-fuel ratio. Further, in the present embodiment, if diagnosis of abnormality is started, the voltage V applied to the downstream side air-fuel ratio sensor 41 is made a fourth voltage $V_4$ (for example, 0.45V). Here, the fourth voltage $V_4$ is the voltage in the limit current region formed in the state where exhaust gas of a stoichiometric air-fuel ratio circulates around the downstream side air-fuel ratio sensor 41 when the downstream side air-fuel ratio sensor 41 is not abnormal.

After that, in the present embodiment, the voltage applied to the downstream side air-fuel ratio sensor 41 is maintained constant over a predetermined constant time Δt from the time $t_2$ after the elapse of a predetermined time $\Delta t_0$ from the time $t_1$, Here, the time $\Delta t_0$ is made the time required for the output air-fuel ratio of the downstream side air-fuel ratio sensor 41 to converge at the stoichiometric air-fuel ratio as a result of the target air-fuel ratio being changed to the stoichiometric air-fuel ratio even if for example the output air-fuel ratio of the downstream side air-fuel ratio sensor 41 had become a rich air-fuel ratio at the time $t_1$.

After that, in the present embodiment, at the time $t_3$ after a predetermined constant time Δt elapses from the time $t_2$, the voltage V applied to the downstream side air-fuel ratio sensor 41 is lowered to a third voltage $V_3$ (for example, 0.1V). Here, the third voltage $V_3$ is the voltage inside the proportional region Wip occurring in the state where exhaust gas of the stoichiometric air-fuel ratio circulates around the downstream side air-fuel ratio sensor 41 when the downstream side air-fuel ratio sensor 41 is not abnormal. In the present embodiment, the voltage applied to the downstream side air-fuel ratio sensor 41 is maintained constant over a predetermined constant time Δt from the time $t_3$ when the voltage V applied to the downstream side air-fuel ratio sensor 41 is changed to the third voltage $V_3$.

In the example shown in FIG. 13, the diagnosis of abnormality is ended at the time $t_4$ after a predetermined constant time Δt elapses from the time $t_3$. Therefore, at the time $t_4$, the voltage applied to the downstream side air-fuel ratio sensor 41 is made to rise to the voltage for normal control (for example, 0.45V), and the target air-fuel ratio is returned to the rich set air-fuel ratio AFTrich, then the normal control shown in FIG. 5 is performed.

Here, in the present embodiment as well, when the downstream side air-fuel ratio sensor 41 is normal, the output current at the time when the voltage V applied to the downstream side air-fuel ratio sensor 41 in the state where the exhaust air-fuel ratio around the downstream side air-fuel ratio sensor 41 is the stoichiometric air-fuel ratio is a voltage $V_4$ inside the limit current region is detected or calculated in advance by experiments or by computation as the normal value inside the limit current region. Similarly, when the downstream side air-fuel ratio sensor 41 is normal, the output current at the time when the voltage V applied to the downstream side air-fuel ratio sensor 41 in the state where the exhaust air-fuel ratio around the downstream side air-fuel ratio sensor 41 is the stoichiometric air-fuel ratio is a voltage $V_3$ inside the proportional region is detected or calculated in advance by experiments or by computation as the normal value outside the limit current region.

Further, when performing the control such as shown in FIG. 13, if the detected value of the output current I of the downstream side air-fuel ratio sensor 41 at the times $t_2$ to $t_3$ substantially matches the corresponding normal value inside the limit current region and the detected value of the output current I of the downstream side air-fuel ratio sensor 41 at the times $t_3$ to $t_4$ substantially matches the corresponding normal value outside the limit current region, it is judged that the downstream side air-fuel ratio sensor 41 is normal. Further, if the difference between the detected value of the output current I of the downstream side air-fuel ratio sensor 41 at the times $t_2$ to $t_3$ and the corresponding normal value inside the limit current region is the reference value or more and the difference of the detected value of the output current I of the downstream side air-fuel ratio sensor 41 at the times $t_3$ to $t_4$ and the corresponding normal value outside the limit current region is the reference value or more, it is judged that the downstream side air-fuel ratio sensor 41 has an offset type deviation.

On the other hand, if the difference of the detected value of the output current I of the downstream side air-fuel ratio sensor 41 at the times $t_2$ to $t_3$ and the corresponding normal value inside the limit current region is the reference value or more and the detected value of the output current I of the downstream side air-fuel ratio sensor 41 at the times $t_3$ to $t_4$ substantially matches the corresponding normal value outside the limit current region, it is judged that the downstream side air-fuel ratio sensor 41 has a slope type deviation. Furthermore, if the detected value of the output current I of the downstream side air-fuel ratio sensor 41 at the times $t_2$ to $t_3$ substantially matches the corresponding normal value inside the limit current region and the difference of the detected value of the output current I of the downstream side air-fuel ratio sensor 41 at the times $t_3$ to $t_4$ and the corresponding normal value outside the limit current region is the reference value or more, it is judged that the downstream side air-fuel ratio sensor 41 has an abnormality of the reference gas.

Note that, FIG. 13 shows the case of maintaining the target air-fuel ratio constant at the stoichiometric air-fuel ratio, but the target air-fuel ratio may also be maintained at an air-fuel ratio other than the stoichiometric air-fuel ratio. However, in this case, the oxygen storage amount of the upstream side exhaust purification catalyst 20 has to reach the maximum storable amount of oxygen or zero before the air-fuel ratio of the exhaust gas circulating around the downstream side air-fuel ratio sensor 41 stabilizes. For this reason, the time required for the air-fuel ratio of the exhaust gas circulating around the downstream side air-fuel ratio sensor 41 to settle down, that is, the time $\Delta t_0$, is made a relatively long time.

According to the present embodiment, as explained above, by detecting the output current of an air-fuel ratio sensor in the state applying a voltage inside the limit current region and a voltage inside the proportional region to an air-fuel ratio sensor 40 or 41, it is possible to differentiate the different modes of abnormality in particular as abnormalities due to offset type deviation and abnormalities due to other causes.

Further, in the first embodiment, abnormality is diagnosed during fuel cut control or during post-reset rich control. However, fuel cut control and post-reset rich control are performed in accordance with the engine operating state. In some cases, they are not performed for a long period of time. For this reason, sometimes it is not possible to diagnose abnormality over a long period of time. As opposed to this, in the present embodiment, it is sufficient to temporarily suspend normal control and maintain the target air-fuel ratio at a constant value, and therefore it is possible to diagnose abnormality at any timing.

Note that, in the above second embodiment, in diagnosis of abnormality, the target air-fuel ratio is maintained at a predetermined constant air-fuel ratio. However, in diagnosis of abnormality, the target air-fuel ratio may also be switched between the rich air-fuel ratio and the lean air-fuel ratio alternately at short intervals. If alternately switching the target air-fuel ratio between the rich air-fuel ratio and the lean air-fuel ratio at short intervals in this way, the unburned gas and air in the exhaust gas are removed at the upstream side exhaust purification catalyst 20. For this reason, the air-fuel ratio of the exhaust gas circulating around the downstream side air-fuel ratio sensor 41 is maintained constant at the stoichiometric air-fuel ratio. In this case, the target air-fuel ratio has to be alternately changed between the rich air-fuel ratio and the lean air-fuel ratio so that the oxygen storage amount of the upstream side exhaust purification catalyst 20 is maintained at an amount greater than zero and smaller than the maximum storable amount of oxygen.

<Flow Chart>

Figure 14:
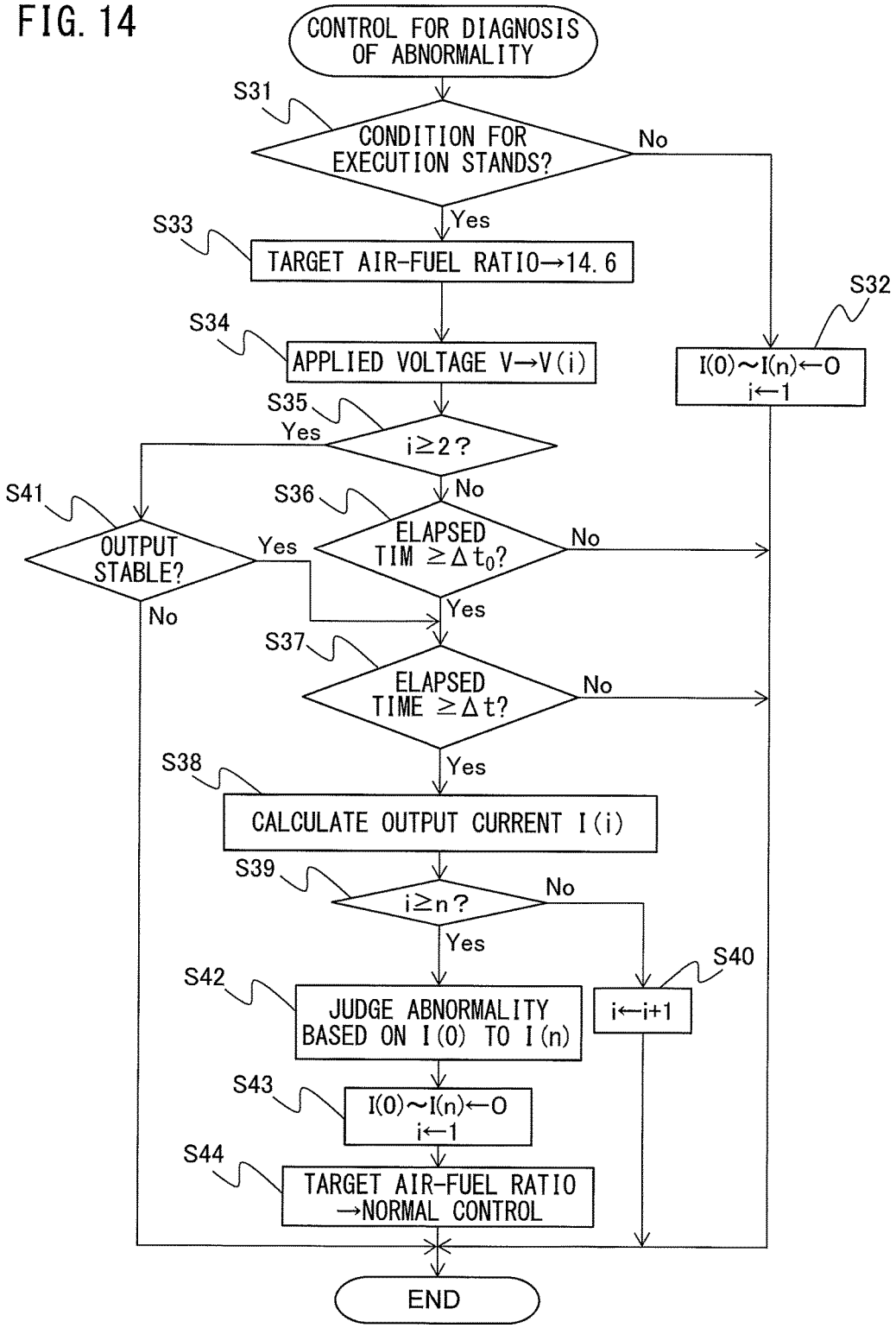
FIG. 14 is a flow chart for diagnosis of abnormality of a downstream side air-fuel ratio sensor.

FIG. 14 is a flow chart of the control routine for diagnosis of abnormality of the downstream side air-fuel ratio sensor 41. The illustrated control routine is performed by interruption at every constant time interval.

As shown in FIG. 14, first, at step S31, it is judged if the condition for diagnosis of abnormality stands. If at step S31 it is judged if the condition for diagnosis of abnormality does not stand, the routine proceeds to step S32. At step S32, the number of times "i" of application of different voltage is reset to 1, the output currents I(0) to I(n) at the time of the first to n-th applications of voltage are reset to 0, then the control routine is made to end.

On the other hand, if at step S32 it is judged that the condition for diagnosis of abnormality stands, the routine proceeds to step S33. At step S33, the target air-fuel ratio is made the stoichiometric air-fuel ratio (14.6). Next, at step S34, in the same way as step S14, the voltage V applied to the downstream side air-fuel ratio sensor 41 is made the i-th applied voltage V(i). Next, at step S35, it is judged if the number of times "i" of application of different voltage is 2 or more. When the number of times "i" of application is 1, the routine proceeds to step S36. At step S36, it is judged if the elapsed time from when setting the target air-fuel ratio to the stoichiometric air-fuel ratio is the above-mentioned predetermined time $\Delta t_0$ or more. If at step S36 it is judged that the elapsed time from when setting the target air-fuel ratio to the stoichiometric air-fuel ratio is less than the above-mentioned predetermined time $\Delta t_0$, that is, if it is judged that sometimes the air-fuel ratio of the exhaust gas circulating around the downstream side air-fuel ratio sensor 41 has not stabilized, the control routine is made to end.

On the other hand, if at step S36 it is judged that the elapsed time is a predetermined time $\Delta t_0$ or more, the routine proceeds from step S36 to step S37. At step S37, it is judged if the elapsed time from when it was judged the elapsed time from when the target air-fuel ratio was set to the stoichiometric air-fuel ratio is the predetermined time $\Delta t_0$ or more is a predetermined constant time $\Delta t$ or more. If at step S37 it is judged that the elapsed time is a constant time $\Delta t$ or more, the routine proceeds from step S37 to step S38. At step S38, the average value of the output current I of the downstream side air-fuel ratio sensor 41 in the period until a constant time $\Delta t$ elapses is calculated. This average value is made the output current I(i) when applying the i-th applied voltage V(i). Next, at step S39, it is judged if the number of times "i" of application of different voltage is "n" or more. If the current number of times "i" of application of different voltage is smaller than "n", the routine proceeds to step S40. At step S40, the number of times "i" of application of different voltage is incremented by 1, then the control routine is made to end.

If the number of times "i" of application of different voltage is incremented by 1 and the number of times of application of different voltage becomes 2, at the next control routine, the routine proceeds from step S35 to step S41. At step S41, it is judged if the output current I of the downstream side air-fuel ratio sensor 41 has stabilized from when the applied voltage was changed. If at step S35 it is judged that the output current I of the downstream side air-fuel ratio sensor 41 has not stabilized, the control routine is made to end. On the other hand, if the output current I of the downstream side air-fuel ratio sensor 41 stabilizes, the routine proceeds from step S41 to step S37. After that, the routine proceeds through steps S37 and S38 to step S39. At step S39, it is again judged if the number of times "i" of application of different voltage is "n" times or more. When "n" is 2, it is judged that the number of times "i" of application of different voltage is "n" times or more. On the other hand, when "n" is 3 or more, steps S31 to S38 are repeated until the number of times of application of different voltage becomes "n" times. If at step S39 it is judged that the number of times "i" of application of different voltage is "n" times or more, the routine proceeds to step S42.

At step S42, the mode of abnormality of the downstream side air-fuel ratio sensor 41 is judged by comparing these with the normal values explained above based on the output currents I(0) to I(n) calculated at step S38. Next, at step S43, the number of times "i" of application of different voltage is reset to 1 and the output currents at the time of the first to n-th applications of voltage are reset to 0. Next, at step S44, the target air-fuel ratio is set to the target air-fuel ratio at normal control, then the control routine is made to end.

REFERENCE SIGNS LIST

1. engine body
5. combustion chamber
7. intake port
9. exhaust port
19. exhaust manifold
20. upstream side exhaust purification catalyst
24. downstream side exhaust purification catalyst
31. ECU
40. upstream side air-fuel ratio sensor
41. downstream side air-fuel ratio sensor

The invention claimed is:

1. An abnormality diagnosis system of an air-fuel ratio sensor, the air-fuel ratio sensor being provided in an exhaust passage of an internal combustion engine, that generates an output current, including a limit current corresponding to an air-fuel ratio, wherein the system comprises a current detecting part detecting the output current of the air-fuel ratio sensor and an applied voltage control device controlling voltage applied to the air-fuel ratio sensor, wherein the applied voltage control device is configured, when the air-fuel ratio of the exhaust gas flowing around the air-fuel ratio sensor is a predetermined constant air-fuel ratio, to apply a first voltage inside a limit current region where the constant limit current is generated and apply a second voltage outside the limit current region, wherein the applied voltage control device judges a type of abnormality occurring at the air-fuel ratio sensor based on the output current of the air-fuel ratio sensor detected by the current detecting part, wherein, when the air-fuel ratio of the exhaust gas flowing around the air-fuel ratio sensor is the predetermined constant air-fuel ratio, an output current when applying the first voltage and an output current when applying the second voltage are respectively detected in advance of an abnormality measurement to set a normal first current value inside the limit current region when the first voltage is applied and a normal second current value outside the limit current region when the second voltage is applied, when the air-fuel ratio sensor operates normally, and wherein, when the air-fuel ratio of the exhaust gas flowing around the air-fuel ratio sensor is the predetermined constant air-fuel ratio, the type of abnormality occurring at the air-fuel ratio sensor is judged based on a comparison between an actual output current value when the first voltage is applied and the normal first current value, and a comparison between an actual output current value when the second voltage is applied and the normal second current value.

2. The abnormality diagnosis system of an air-fuel ratio sensor according to claim 1, wherein the voltage outside the limit current region is a voltage lower than the limit current region.

3. The abnormality diagnosis system of an air-fuel ratio sensor according to claim 1, wherein when the difference between the detected actual output current value when the first voltage is applied and the normal first current value is a predetermined reference value or more, and the difference between the detected actual output current value when the second voltage is applied and the normal second current value is the predetermined reference value or more, it is judged that an offset type deviation where the output current of the air-fuel ratio sensor is deviated overall from the air-fuel ratio of the exhaust gas circulating around the air-fuel ratio sensor has occurred at the air-fuel ratio sensor.

4. The abnormality diagnosis system of an air-fuel ratio sensor according to claim 3, wherein when the difference between the detected actual output current value when the first voltage is applied and the normal first current value is a predetermined reference value or more, and the difference between the detected actual output current value when the second voltage is applied and the normal second current value is less than the predetermined reference value, it is judged that a slope type deviation where the change of the output current of the air-fuel ratio sensor is deviated from the change of the air-fuel ratio of the exhaust gas circulating around the air-fuel ratio sensor has occurred at the air-fuel ratio sensor.

5. The abnormality diagnosis system of an air-fuel ratio sensor according to claim 1, wherein when the difference between the detected actual output current value when the first voltage is applied and the normal first current value is a predetermined reference value or more, and the difference between the detected actual output current value when the second voltage is applied and the normal second current value is less than the predetermined reference value, it is judged that a slope type deviation where the change of the output current of the air-fuel ratio sensor is deviated from the change of the air-fuel ratio of the exhaust gas circulating around the air-fuel ratio sensor has occurred at the air-fuel ratio sensor.

6. The abnormality diagnosis system of an air-fuel ratio sensor according to claim 1, wherein the internal combustion engine comprises an exhaust purification catalyst arranged in the exhaust passage, an upstream side air-fuel ratio sensor arranged at an upstream side of the exhaust purification catalyst in the direction of exhaust flow in the exhaust passage, and a downstream side air-fuel ratio sensor arranged at a downstream side of the exhaust purification catalyst in the direction of exhaust flow in the exhaust passage and wherein the downstream side air-fuel ratio sensor is comprised of the limit current type air-fuel ratio sensor.

7. The abnormality diagnosis system of an air-fuel ratio sensor according to claim 1, wherein the internal combustion engine comprises an exhaust purification catalyst arranged in the exhaust passage, an upstream side air-fuel ratio sensor arranged at an upstream side of the exhaust purification catalyst in the direction of exhaust flow in the exhaust passage, and a downstream side air-fuel ratio sensor arranged at a downstream side of the exhaust purification catalyst in the direction of exhaust flow in the exhaust passage and wherein the upstream side air-fuel ratio sensor is comprised of the limit current type air-fuel ratio sensor.

8. The abnormality diagnosis system of an air-fuel ratio sensor according to claim 7, wherein the internal combustion engine can carry out fuel cut control wherein feed of fuel to a combustion chamber is stopped during operation of the internal combustion engine as fuel cut control and, post-reset rich control wherein the air-fuel ratio of the exhaust gas flowing into the exhaust purification catalyst is made a rich air-fuel ratio richer than the stoichiometric air-fuel ratio after the end of the fuel cut control, and the time when the air-fuel ratio of the exhaust gas flowing around the air-fuel ratio sensor is maintained at the predetermined constant air-fuel ratio is during the post-reset rich control.

9. The abnormality diagnosis system of an air-fuel ratio sensor according to claim 7, wherein the internal combustion engine performs feedback control so that the output air-fuel ratio of the upstream side air-fuel ratio sensor becomes a target air-fuel ratio, and the time when the air-fuel ratio of the exhaust gas flowing around the air-fuel ratio sensor is maintained at the predetermined constant air-fuel ratio is the time when the target air-fuel ratio is maintained constant at a predetermined air-fuel ratio.

10. The abnormality diagnosis system of an air-fuel ratio sensor according to claim 7, wherein the internal combustion engine performs feedback control so that the output air-fuel ratio of the upstream side air-fuel ratio sensor becomes a target air-fuel ratio, and the time when the air-fuel ratio of the exhaust gas circulating around the air-fuel ratio sensor is alternately changed between a rich air-fuel ratio richer than the stoichiometric air-fuel ratio and a lean air-fuel ratio leaner than the stoichiometric air-fuel ratio, the rich air-fuel ratio and the lean air-fuel ratio being maintained constant throughout their respective alternate turns, so that an oxygen storage amount of the exhaust purification catalyst is maintained at an amount greater than zero and less than the maximum storable amount of oxygen.

11. The abnormality diagnosis system of an air-fuel ratio sensor according to claim 1, wherein the internal combustion engine can carry out fuel cut control wherein feed of fuel to a combustion chamber is stopped during operation of the internal combustion engine, and the time when the air-fuel ratio of the exhaust gas flowing around the air-fuel ratio sensor is maintained at the predetermined constant air-fuel ratio is during the fuel cut control.

* * * * *